US007093931B2

(12) United States Patent
Ishii et al.

(10) Patent No.: US 7,093,931 B2
(45) Date of Patent: Aug. 22, 2006

(54) FIXED MATERIAL TRANSPORTATION APPARATUS, FIXED MATERIAL DISCHARGING APPARATUS, METHOD FOR DISCHARGING THE FIXED MATERIAL, AND LIQUID FIXING APPARATUS

(75) Inventors: Takayuki Ishii, Nagano (JP); Tatsuya Seshimo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/272,300

(22) Filed: Oct. 17, 2002

(65) Prior Publication Data

US 2003/0085979 A1 May 8, 2003

(30) Foreign Application Priority Data

Oct. 17, 2001 (JP) ..... P2001-319519
Mar. 29, 2002 (JP) ..... P2002-093825
Mar. 29, 2002 (JP) ..... P2002-093826
Mar. 29, 2002 (JP) ..... P2002-093827

(51) Int. Cl.
*B41J 2/01* (2006.01)

(52) U.S. Cl. ..... 347/104

(58) Field of Classification Search ..... 347/102, 347/104; 101/424.1
See application file for complete search history.

(56) References Cited

U.S. PATENT DOCUMENTS 4,463,361 A 7/1984 Koumura et al.
4,572,071 A 2/1986 Cappel et al.
4,657,236 A 4/1987 Hirakawa et al.
6,022,104 A * 2/2000 Lin et al. ..... 347/102
6,152,444 A 11/2000 Elgee et al.
6,224,203 B1 * 5/2001 Wotton et al. ..... 347/101

FOREIGN PATENT DOCUMENTS

| | | |
|---|---|---|
| EP | 0 992 347 A2 | 4/2000 |
| JP | 62-29357 U | 2/1987 |
| JP | 03-000270 | 1/1991 |
| JP | 8-156351 | 6/1996 |
| JP | 09-300752 | 11/1997 |
| JP | 63-303781 | 12/1998 |
| JP | 11-071042 | 3/1999 |
| JP | 2000-158637 | 6/2000 |
| JP | 2000-246983 | 9/2000 |
| JP | 2000-246983 A | 9/2000 |
| JP | 2001-187473 | 7/2001 |
| WO | WO 01/56804 A1 | 8/2001 |
| WO | WO 01/56804 A1 | 8/2003 |

* cited by examiner

*Primary Examiner*—Stephen Meier
*Assistant Examiner*—Julian D. Huffman
(74) *Attorney, Agent, or Firm*—Sughrue Mion, PLLC

(57) ABSTRACT

The present invention involves a sucking device having a fixed material transportation surface including plural sucking holes, a decompression chamber connecting to the plural sucking holes, and a sucking device sucking air in the decompression chamber. The fixed material is fed on the fixed material transportation surface of the sucking device by the delivering device, and is stuck on the fixed material transportation surface through the sucking holes by the sucking device. The fixed material is fixed by a fixing head at the state of being stuck and is transported gradually to a downstream side by the delivering device on the fixed material transportation surface. When fixing is finished, the fixed material separates from the surface of the fixed material transportation surface and rises slightly by blowing air from the sucking holes by a blowing device so as to move to a discharging direction.

13 Claims, 16 Drawing Sheets

FIXED MATERIAL TRANSPORTATION APPARATUS, FIXED MATERIAL DISCHARGING APPARATUS, METHOD FOR DISCHARGING THE FIXED MATERIAL, AND LIQUID FIXING APPARATUS

BACKGROUND OF THE INVENTION

The present invention relates to a fixed material transportation apparatus, an fixed material discharging apparatus, a method for discharging the fixed material, and a liquid fixing apparatus having the carrier apparatus and the discharging the apparatus, particularly to technology for drawing, keeping, and discharging smoothly the fixed material in a recording portion of the liquid fixing apparatus after finishing to fix.

FIG. 15 is a side view showing an example of inner construction of an ink jet printer being one of general liquid fixing apparatus and discharging recording a medium. The ink jet printer includes a sheet feed roller 1 and a hopper 2 as an automatic sheet feeder, includes a delivery roller 3, a driven roller 4, a transportation stage 5, a discharging roller 6, and a roller with teeth (a discharging serrated roller) 7 as a carrier, and includes a carriage 8 and a recording head 9 as a recorder.

The ink jet printer having such the construction feeds a sheet, for example, which is recording medium by the automatic sheet feeder, and prints letter and picture by discharging ink droplet on the sheet using recording device while transporting the sheet by transportation apparatus. That is, a control portion of the ink jet printer presses recording media P of plural sheets piled in the hopper 2 to the sheet feed roller 1 by raising the hopper 2 rotating the sheet feeder 1 and feeds the top sheet of the recording media P separating from the lower part of the recording media P. The recording media P is sandwiched between the delivery roller 3 and the driven roller 4 and transported onto the transportation stage 5 rotating the delivery roller 3.

Next, ink of each color is supplied to a pressure generating chamber of the recording head 9 mounted at the carriage 8 from ink cartridges of total four colors of yellow, magenta, cyan, and black for example, and ink droplets are discharged to the recording medium P from a nozzle opening pressurizing ink in the pressure generating chamber. At this time, highly accurate ink dot control, halftone process, and the like are performed by controlling discharging timing of each color ink and driving of the carriage 8 and the delivery roller 3. The recording medium P is discharged onto a discharging stacker not shown rotating the discharging roller 6 by sandwiching the recording medium between the discharging roller 6 and the discharging serrated roller 7.

In such the ink jet printer, pressing force of the discharging serrated roller is set to degree that a spur mark (a scar of rowel spur) does not remain on the recording medium P at discharging the recording medium P as shown in FIG. 16A. However, in the case that picture where many ink particles are discharged on the recording medium P like solid picture is recorded, the recording medium P absorbs a lot of ink and expands in wave shape to the recording head 9 side so as to generate possibly so called cockling as shown in FIG. 16B.

There are faults that recording unevenness generates by dispersion of flying distance of ink particles because gap between the recording medium P and the recording head 9 becomes narrow and the recording medium P gets dirty because of attaching to the recording head 9 at generating the generation of the cockling. Even in the transportation apparatus of the recording medium shown in FIG. 16A, it is possible to prevent the above faults by depressing the above cockling within tolerance if the span between the delivery roller 3 and discharging roller 6 is comparatively short.

However, it is necessary in near future to increase number of nozzles of every nozzle of each color or to arrange nozzle lines of plural colors to transportation direction of the recording medium to make recording speed further high in the ink jet printer and the like. In these cases, dimension of the recording head becomes long to transportation direction of the recorder medium as shown in FIG. 16C. When the recording head 9 is long, span between the delivery roller 3 and the discharging roller 6 becomes long so as not to prevent the cockling absolutely and so that the cockling gets over tolerance in the construction transporting and discharging by sandwiching the delivery roller 3 (and the driven roller 4) and the discharging roller 6 (and discharging serrated roller 7 as the driven roller thereof). Therefore, the cockling goes over allowance, and it is considerable that the construction transporting and discharging by sandwiching with such the two pairs of rollers itself is not realized depending on kinds of apparatus such as the ink jet printer having long head length and the like.

Such the cockling is comparably small at using exclusive sheet for ink jet printer and the like as a recording medium, and is large at using normal sheet. Because of that, paper gap [gap A between the recording medium P and the recording head 9 in FIG. 16A] is set large considering rise of the sheet caused by cockling at using the normal sheet in the design of ink jet printer and the like. However, when the paper gap is large like this, ink particles discharged from the nozzle of the recording head generate flying curve and divergence of point of impact becomes large for the flying curve so as to prevent possibly from improving printing quality even at using needless exclusive sheet.

Further, when the recording medium P rises by cockling, the floated recording medium P is pressed by the discharging serrated roller 7 as shown with arrow B in FIG. 16B, thereby the spur mark run over caused by the discharging serrated roller 7 remains at the recording medium P as shown in FIG. 17. The spur mark is conspicuous especially at the normal sheet large in cockling and causes decreasing printing quality.

On the other hand, various kinds of printers having mainly a sucking portion of hollow box shape at transportation surface of the recording medium and sucking the recording medium through plural sucking holes (through holes) provided at the sucking portion by a sucking pump and the like are proposed in recent yeas (see JP-A-63-303781, JP-A-3-270, etc.). Among them, there is a printer proposed that the recording medium is sucked or stuck to a platen and the like through these sucking holes.

However, only through holes are opened to suck at the sucking portion of the hollow box shape in both of them, and it is difficult to prevent the above cockling over whole surface of the recording medium in the recording portion. A projecting part from the recording portion of the recording medium rises and is pressed by the discharging serrated roller 7 as shown with arrow B in FIG. 16B. As the result, it can not prevent that the spur mark remains at the recording medium P.

Further, since the prior art described in the above official gazette has the construction that only through holes are opened to suck at the sucking portion of the hollow box shape, strong sucking force possibly causes fall of transporting accuracy. Because of that, in the present circumstances, a printer is not made practicable except a part of large-sized printer performing transportation (using its own weight of the sheet for transportation) to gravity direction as the actual situation.

The above ink jet printer can print a forward end (upper end, hereafter) of transportation direction and a backward end (lower end, hereafter) of transportation direction of the recording medium P without a margin. The printing without margin of upper and lower ends is need that transportation speed of the recording medium P by the delivery roller 3 is changed to slower speed than normal speed and a part of nozzles is used for ink discharging to the recording medium P by the recording head 9.

Thus, although the printing without margin of upper and lower ends can not use whole nozzles, the reason is as the following. That is, although ink run off from the upper and lower ends of the recording medium P is stuck on the transportation stage 5 at performing the printing without margin of upper and lower ends, the recording medium P is possibly contaminated when ink is stuck on the transportation stage 5. Then, ink absorbing materials 5*b* and 5*c* receiving and absorbing ink run off from the upper and lower ends of the recording medium P are buried at both sides of a rib 5*a* formed at the transportation stage 5 to keep paper gap between the recording medium P and the recording head 9 and to reduce transportation resistance generating between the recording medium P and the transportation stage 5 as shown in FIG. 15.

Gap of the ink absorbing materials 5*b* and 5*c* varies by number of nozzles using for the printing without margin of upper and lower ends. For example, when the numbers of nozzles using for the printing without margin of upper and lower ends are increased, gap of the ink absorbing materials 5*b* and 5*c* must be close, thereby the length of the rib 5*a* becomes necessarily short. However, the rib 5*a* needs some degree of length to support the recording medium P firmly and to keep stable paper gap.

Therefore, number of nozzles enabling to use is determined necessarily considering necessary length of the rib 5*a* and accuracy of start of the recording medium P, accuracy of length of the recording medium P, each dispersion of transporting accuracy, not printing at the rib 5*a* at the printing without margin of upper and lower ends even in the case of the shortest start, and not printing at the rib 5*a* at the printing without margin of upper and lower ends even in the case of the shortest length of the sheet.

That is, the printing without margin of upper and lower ends can not perform using whole nozzles, ink must be discharged by a part of nozzles, therefore it is necessary to transport the recording medium P with slower speed than usual speed. Therefore, printing work time becomes long because printing speed without margin of upper and lower ends becomes slower than normal printing speed. Disturbance of picture quality possibly generates at border part of process domain without margin of upper and lower ends and normal process domain because transportation quantity of the recording medium P without margin of upper and lower ends becomes less than transportation quantity of normal recording medium P.

SUMMARY OF THE INVENTION

An object of the invention is to prevent more usefully cockling of a fixed material in a liquid fixing apparatus and not to remain a spur mark by discharging serrated roller by discharging smoothly the fixed material after finishing printing.

An another object of the invention is to shorten especially recording work time in the case of recording without margin of a lower end of the fixed material so as to improve recording quality.

In order to solve the above problems, in the invention, a sucking device having a fixed material transportation surface including plural sucking holes, a decompression chamber connecting to the plural holes, and a sucking device sucking air in the decompression is set at discharging side of fixed material in a liquid fixing apparatus. In the construction sucking to stick the fixed material through the sucking holes provided at the sucking device, the fixed material is separated from the fixed material transportation surface by blowing away air from the sucking holes after finishing fixing, and is further moved subsidiarily to discharging direction.

(1) The fixed material transportation apparatus of the invention is characterized by comprising a sucking device keeping to suck a fixed material and a delivering device transporting a fixed material from upstream side to downstream side of the sucking device, the sucking device has a fixed material transportation surface including plural sucking holes, a decompression chamber connecting to these plural sucking holes, and a sucking device sucking air in the decompression chamber, the fixed material being transported from the upstream side to the downstream side while the fixed material supplied on the fixed material transportation surface of the sucking device by the delivering device is stuck on the fixed material transportation surface through the sucking holes by a sucking device at fixing, wherein the delivering device includes a blowing device blowing air into the decompression chamber of the sucking device after finishing to fix liquid and an auxiliary transporting device moving subsidiarily the fixed material to discharging direction.

According to the construction, the fixed material is supplied on the fixed material transportation surface of the sucking device by the delivering device, and is stuck on the fixed material transportation surface through the sucking holes by the sucking device. The fixed material is fixed by a fixing head at the state being sucked on the fixed material transportation surface, and transported gradually from the upstream side to the downstream side by the delivering device. After that, when fixing is finished, the fixed material separates from surface of the fixed material transportation surface and rises slightly by blowing air from the sucking holes by the blowing device, and is moved to discharging direction, that is, the downstream side by the auxiliary transporting device. Thus, since the fixed material separates from the fixed material transportation surface of the fixed material transportation apparatus and is moved to discharging direction after finishing fixing so as to discharge smoothly, the prior discharging serrated roller is not necessary so as not to-remain the spur mark run over by the discharging serrated roller on the fixed material at discharging.

(2) The fixed material transportation apparatus is characterized in that the auxiliary transporting device is constructed by that each sucking hole of the sucking device is opened slantingly to discharging direction of the fixed material in the fixed material transportation apparatus of (1). According to the construction, after finishing fixing, the fixed material separates from surface of the fixed material transportation surface and rises slightly by blowing air from the sucking holes by the blowing device, and is moved to discharging direction putting on air current blown from the sucking holes by that the sucking holes open slantingly to discharging direction.

(3) The fixed material transportation apparatus of (3) is characterized in that the auxiliary transporting device is constructed by that the fixed material transportation surface of the sucking device is formed inclined so as to become low to discharging direction of the fixed material transportation apparatus of (1). According to the construction, after finishing fixing, the fixed material separates from surface of the fixed material transportation surface-and rises slightly by blowing air from the sucking holes by the blowing device, and the fixed material transportation surface is formed so as to become low to discharging direction, therefore the fixed material is moved to discharging direction by own weight of the fixed material.

(4) The fixed material transportation apparatus is characterized in that the blowing device is used as a sucking device and air is blown into the decompression chamber by reversing the sucking device the fixed material transportation apparatus of (2) or (3). According to the construction, since air can be blown from the sucking holes as the blowing device by reversing the sucking device using the sucking device of the existing a sucking device, rise of cost is depressed by the simple structure.

(5) A liquid fixing apparatus of the invention is characterized by including the fixed material transportation apparatus. According to the construction, after finishing fixing, since the fixed material separates from surface of the fixed material transportation surface and rises slightly by blowing air from the sucking holes by the blowing device, and is moved to discharging direction, that is, the downstream side by the auxiliary transporting device, the prior discharging serrated roller is not necessary so as not to remain the spur mark run over by the discharging serrated roller at the-fixed material at discharging.

(6) The fixed material discharging apparatus is characterized in that the discharging apparatus is the device discharging the fixed material from the discharging portion and comprises means floating the fixed material at lower side of the fixed material in the discharging portion and generating an air current to discharging direction of the fixed material, and the fixed material is discharged putting on the air current.

(7) A method for discharging the fixed material of the invention, discharging the fixed material from a discharging portion, is characterized by floating the fixed material at lower side of the fixed material in the discharging portion and generating an air current to discharging direction of the fixed material, and by discharging the fixed material putting on the air current.

(8) A fixed material transportation apparatus of the invention is characterized by comprising a stage enabling to operate suction of a fed fixed material and a reciprocating moving to transportation direction of the fixed material and transporting the fixed material by suitably combining said each operation, and a sucking device sucking to stick the fixed material, wherein an exhaust port blowing air current for discharging the fixed material on the stage moving to the position discharging the material is arranged at lower side of the stage. Thus, since the discharging roller of the fixed material and the like is unnecessary, the fixed material can be discharged at good state without spur mark, rubbing of liquid, and the like.

(9) Exhausted air of the sucking device when the fixed material is sucked at the stage may be used for air current for discharging the fixed material in the fixed material transportation apparatus of (8).

(10) Larger quantity of air current may be generated at discharging the fixed material than at fixing in the fixed material transportation apparatus of (8) or (9).

(11) Quantity of exhausted air current at the position discharging the fixed material may be increased by that a connecting port connecting to the stage and the sucking device exposes by moving of the stage in the fixed material transportation apparatus of (8) to (10). Thus, since passage load is reduced by releasing the connecting port when the stage moves to the discharging position of the fixed material, exhausted air quantity is increased by reducing sucking force sticking the fixed material so as to discharge the fixed material surely.

(12) The liquid fixing apparatus fixing discharging liquid to the transported fixed material includes the fixed material discharging apparatus of (6) or the fixed material transportation apparatus of any of (8) to (11).

(13) According to the invention, the fixed material transportation apparatus comprising a stage enabling to operate suction of a fed fixed material by a delivery roller and a reciprocating moving to transportation direction of the fixed material and transporting the fixed material by suitably combining said each operation, wherein the stage transports the fixed material with the delivery roller before the lower end of the fixed material separates from the delivery roller. Thus, since transfer from the transportation of fixed material by the delivery roller to the transportation of fixed material by the stage can be performed smoothly, fixing quality of whole surface of the fixed material including the lower end can be improved.

(14) A liquid receiving portion receiving liquid thrown away from nozzles at fixing without margin of lower end of the fixed material may be provided at a position where the liquid receiving portion exposes by moving of the stage at a main body portion arranged at the lower side of the stage in the fixed material transportation of (13). Thus, since the fixed material can be transported by moving the stage ticking the lower end of the fixed material on the stage and it is unnecessary to provide the liquid receiving portion for fixing without margin of the lower end at the stage, it is unnecessary to provide the rib need for keeping paper gap and to reduce transportation resistance on the stage. Therefore, since fixing without margin of the lower end can be performed with usual fixing speed using all nozzles, fixing operation time can be shortened and fixing quality of whole surface of the fixed material can be improved.

(15) The supporting portion supporting the lower end of the fixed material separated from the delivery roller may be provided so as to enable to store at the rear portion of the stage in the fixed material transportation apparatus of (13) or (14). Thus, since the lower end of the fixed material projecting from the rear end of the stage is supported by the supporting portion, the fixed material does not fall even if the fixed material is drawn to lower direction by influence of sucking air current sticking the fixed material, and it is possible to keep the stable paper gap over whole surface of the fixed material and to improve fixing quality.

(16) The liquid fixing apparatus, fixing by discharging liquid to the transported fixed material is characterized by providing the fixed material transportation apparatus of any of (13) to (15). Thus, the liquid fixing apparatus having the above-mentioned advantages can be provided.

(17) The fixed material transportation apparatus is characterized by comprising a stage enabling to operate suction of a fed fixed material and a reciprocating moving to transportation direction of the fixed material and transporting the fixed material by suitably combining said each operation, and a sucking device sucking to stick the fixed material, wherein a liquid receiving portion receiving liquid thrown away from nozzles at fixing without margin of an upper end of the fixed material is provided at the stage. Thus, since the fixed material can be transported by moving the stage by sticking the upper end of the fixed material on the stage and one liquid receiving portion for fixing without margin of the upper end may be provided on the stage, it is unnecessary to provide the rib need for keeping paper gap and to reduce transportation resistance on the stage. Therefore, since fixing without margin of the lower end can be performed with usual fixing speed using all nozzles, fixing operation time can be shortened and fixing quality of whole surface of the fixed material can be improved.

(18), The sucking portion sticking the fixed material may be provided at the stage of the upstream side of transportation direction of the fixed material to the liquid receiving portion in the fixed material transportation apparatus of (17). Thus, since the upper and the lower ends of the fixed material can be stuck in plane on the stage, fixing quality is improved keeping stable paper gap over whole fixing domain and it is possible to prevent contamination caused by rubbing with fixing head by reducing rise of the fixed material at fixing domain.

(19) Holes absorbing liquid may be provided at the liquid receiving portion in the fixed material transportation apparatus of (17) or (18). Thus, since liquid can be discharged to outside without accumulating the liquid inside of the liquid receiving portion, contamination of the fixed material by liquid can be reduced and manpower of maintenance such as changing the liquid absorbing material and the like can be reduced comparing with the case only letting the liquid absorbing material absorb.

(20) The stage may move synchronizing to transportation of the fixed material so that the liquid receiving portion faces to the nozzle of the uppermost end all the time when a liquid fixing on the upper end of the fixed material is performed in the fixed material transportation apparatus of any of (17) to (19). Thus, since liquid drops thrown away coming off from the upper end of the fixed material can be received surely in the liquid receiving portion at performing fixing without margin of the upper end, contamination of the fixed material by liquid can be reduced.

(21) The stage may return to a home position after finishing to fix the upper end of the fixed material and during operation of fixing in the fixed material transportation apparatus of any of (17) to (20). Thus, since the fixed material, from the upper end to lower end, can be supported on the stage, it is possible to keep the stable paper gap over whole surface of the fixed material and to improve fixing quality.

(22) The liquid fixing apparatus, fixing liquid on the transported fixed material is characterized in that the liquid fixing apparatus includes the fixed material transportation apparatus of any of (17) to (21). Thus, it is possible to provide the liquid fixing apparatus having the above-mentioned advantages.

DETAILED DESCRIPTION OF THE PREFERRED EMBODIMENTS

An embodiment of the invention will be described in detail below.

Figure 1:
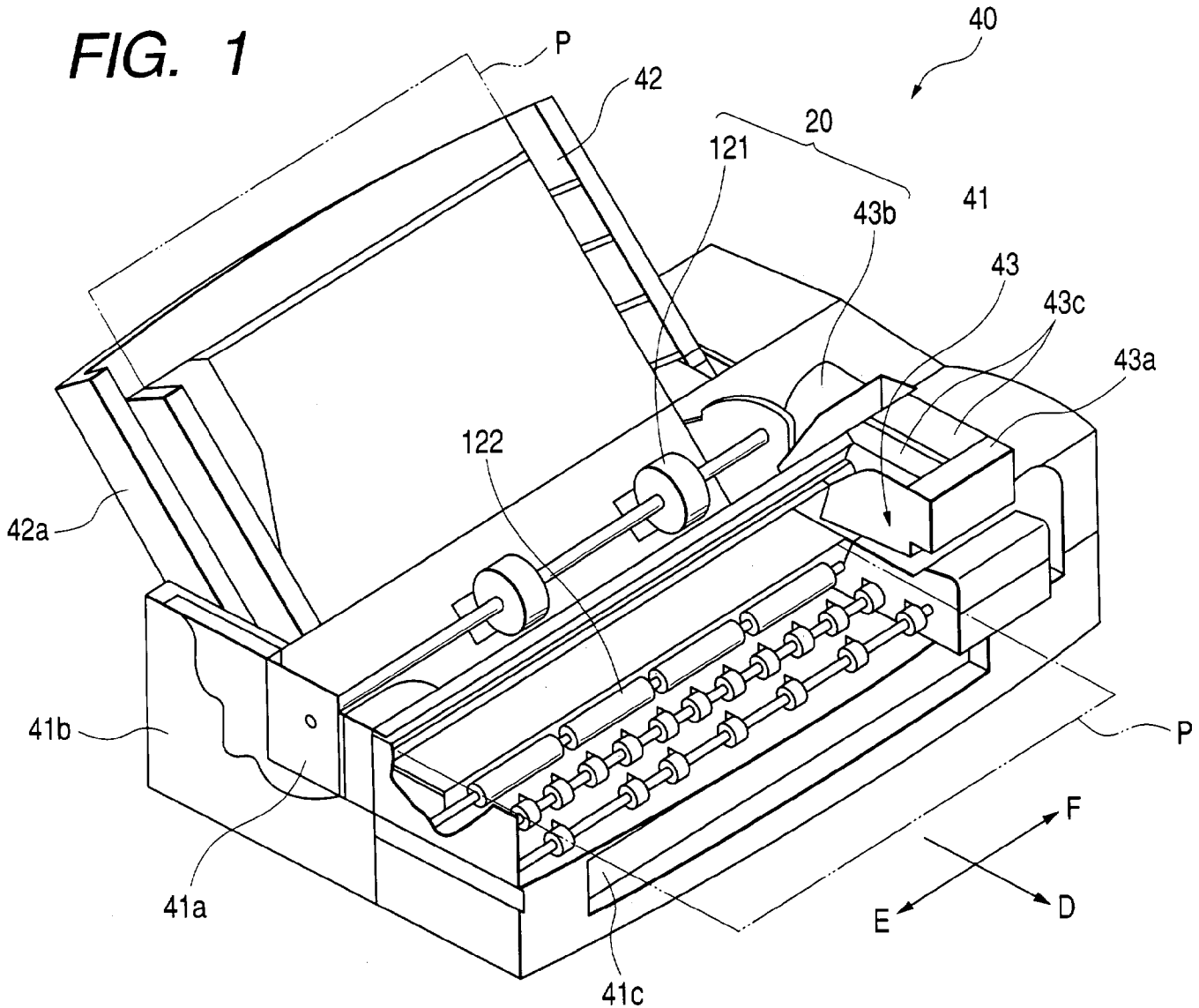
FIG. 1 is a view showing an ink jet printer assembling a recording medium transportation apparatus as a recording apparatus according to the invention.
Figure 2:
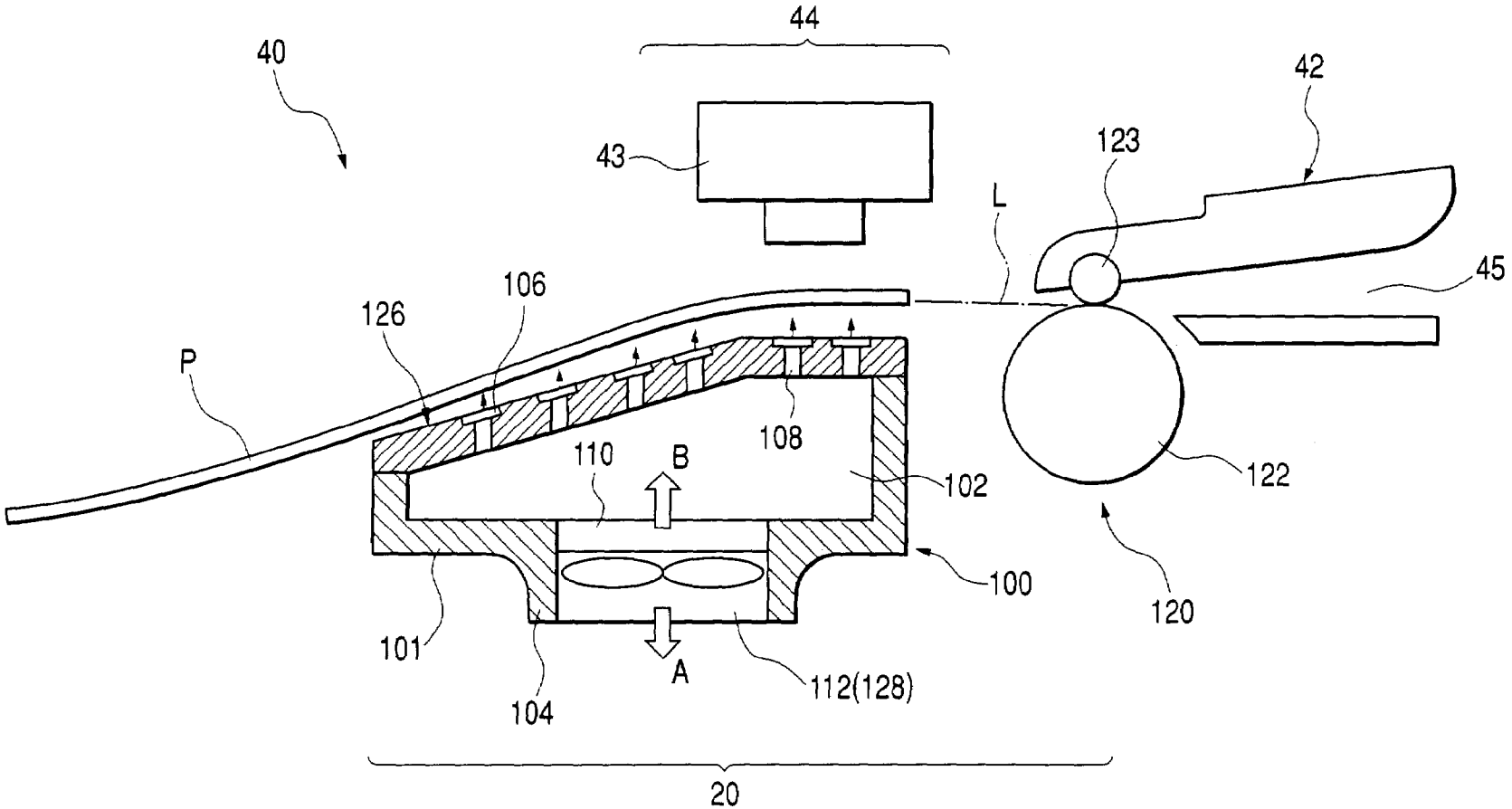
FIG. 2 is a sectional view of outline of a recording medium transportation apparatus according to a first embodiment of the invention.

FIG. 1 shows an ink jet printer assembling a recording medium transportation apparatus as a recording apparatus according to the invention, and FIG. 2 shows the recording medium transportation apparatus according to a first as a main portion thereof. As shown in FIG. 1, the ink jet printer 40 has a construction in which a recording medium P stored in a sheet tray 42*a* of automatic sheet feed (ASF) device 42 attached at a printer main body 41 slantingly is transported to a recording portion 44 consisting of a recording head 43 and a sucking device 100 positioning at lower side of the recording head 43 by a recording medium transportation apparatus 20 transporting to transportation direction D at recording and the recording medium P after recording is discharged out of the printer main body 41.

At the back surface side of the printer main body 41, a manual paper feed port 45 (see FIG. 2) not shown in the FIG. 1 is formed, the recording medium P fed by being put in from the manual paper feed port 45 too similarly is transported to a recording portion 44 by a recording medium transportation apparatus 20 transporting to transportation direction D at recording and the recording medium P after recording is discharged out of the printer main body 41. In FIG. 1, the printer main body 41 includes a supporting frame 41*a*, a case cover 41*b*, and an exhaust port 41*c* of the recording medium P. For the recording medium P, various kinds such as exclusive sheet of ink jet printer, normal sheet, OHP film, tracing paper, post card, and so on can be used.

Here, the recording head 43 is installed at the carriage 43*a* supported by a guide axis (not shown) provided along direction E-F (main scanning direction) rotatably crossing at right angle to transportation direction D (sheet feed direction or sub scanning direction) of the recording medium P in parallel, and the carriage 43*a* slides on the guide axis (not shown) by timing belt driven by a DC motor 43*b*. The recording head 43 has nozzle lines consisting of plural nozzles, for example, 96 pieces etc. at every color, and discharges ink supplied at every color from an ink cartridge 43*c* installed rotatably at the carriage 43*a* on the recording medium P as a small ink particle from all or a part of the above plural nozzles corresponding to printing data.

Figure 3:
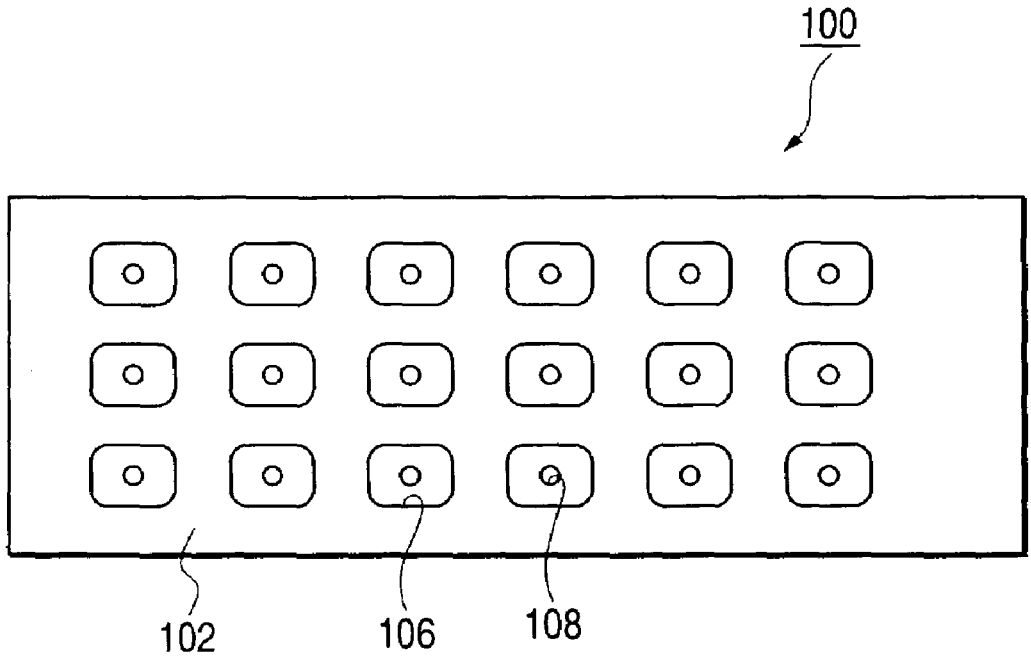
FIG. 3 is a plane view of a sucking device in the recording medium transportation apparatus of FIG. 2.

FIG. 2 is a sectional view showing a construction of main portion of the above recording medium transportation apparatus 20, and FIG. 3 is a plane view of a sucking device thereof. As shown in FIG. 2, the recording medium transportation apparatus 20 includes a sucking device 100 sucking and keeping the recording medium P at recording and a recording medium delivering device 120 transporting the recording medium P to the downstream side from the upstream side of the sucking device 100. The above sucking device 100 is arranged at lower side sandwiching a recording medium transportation passage L to the recording head 43 for printing at the recording medium, and is formed in hollow box shape of construction of two stages, up and down, consisting of a sucking portion 101 of the upper stage and a sucking force generating portion 104 of the lower stage.

The sucking portion 101 has a decompression chamber 102 formed inside, plural sucking chamber 106 formed with almost rectangle concave at transportation surface of the recording medium P, and plural sucking holes 108 (see FIG. 3) extending to up and down directions and having smaller sectional area than the above sucking chamber 106 as shown in FIG. 2. The sucking force generating portion 104 is connected to the decompression chamber 102 of the sucking portion 101 through a connecting hole 110, and has a pump 112 including a centrifugal fan at inside thereof.

The pump 112 is attached at the lower predetermined position of the decompression chamber 102 through the connecting hole 110 at the state connecting to the decompression chamber 102, the centrifugal fan rotates to forward direction at recording, and the fan rotates to reverse direction as a blowing device being an auxiliary transporting device of the recording medium delivering device 120 at discharging the recording medium P after finishing recording as described later.

Figure 4:
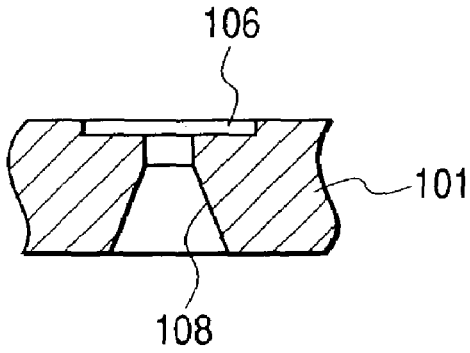
FIG. 4 is partly enlarged sectional view showing variation of a sucking hole in the recording medium transportation apparatus of FIG. 2.

Here, a part corresponding to the sucking hole in the prior sucking structure is formed by the sucking chamber 106 and the sucking hole 108, and utilization factor of negative pressure enabling to use to characteristic of the pump is increased by forming the sucking hole 108 by small diameter through-hole. Large sucking force is applied to the recording medium by forming the sucking chamber 106 forming surface facing to the recording medium as a rectangle concave larger in area. The above sucking hole 108 maybe formed being tapered to the upper surface as shown in FIG. 4.

The above recording medium delivering device 120 is constructed by a feed roller 121 arranged at the lower side of recording medium transportation passage L in the upstream side of the sucking device 100 and the recording head 43, a delivery roller 122 transporting the recording medium P between the recording head 43 and the sucking device 100, and a driven roller 123 pressed from the upper side to the delivery roller 122. Discharging roller and discharging serrated roller are omitted.

Here, the recording medium delivering device 120 further includes an auxiliary transporting device 126 and an air blowing device 128. Although the upper of the sucking portion 101 of the sucking device 100 is formed flat at printing domain facing to the recording head 43 as shown in FIG. 2, the domain of the above auxiliary transporting device 126 is constructed by forming inclined so as to become low to the downstream side from the upstream side, that is, discharging direction at the domain of downstream side from the printing domain.

On the contrary, the above blowing device 128 is constructed so as to blow from surface of the sucking portion 101 from the pump 112 through the sucking hole 108 of the sucking portion 101 and the sucking chamber 106 by rotating the pump 112 reversely using the pump 112 of the sucking force-generating portion 104 of the above sucking device 100 in the case shown in the figure. By that the pump 112 is switched to reverse rotation after finishing printing of the recording medium, air is blown from surface of the sucking portion 101.

The recording medium transportation apparatus 20 according to the embodiment is constructed like above and operates as the following. First, when recording command to the recording medium P stored in the sheet tray 42*a* is inputted from a host computer not shown and the like, the feed roller of the ASF device drives to rotate and the recording medium P stored in the sheet tray 42*a* is picked up each sheet to transport. Further, the delivery roller 122 of recording medium delivering device 120 drive to rotate, and transport so as to send the recording medium P between the recording head 43 and the sucking device 100.

On the other hand, in the sucking device 100, centrifugal fan starts to rotate forward direction, thus sucking force by the pump acts to the sucking hole 108 and the sucking chamber 106 through the connecting hole 110 and the decompression chamber 102 so as to become intake-attraction state. Thus, the recording medium P transported to the recording portion 44 is sucked to stick at printing domain of the recording medium transportation surface of the sucking device 100 so as to be transported keeping the stuck state. At the same time, while moving to main scanning direction E-F at the upper side of the recording medium P, the recording head 43 discharges ink particles to the recording medium P so as to perform picture recording.

After finishing printing of the recording medium P, end edge of the recording medium P is released from between the delivery roller 122 and the driven roller 124 of the recording medium delivering device as shown in FIG. 2. At this time, air blows to upper side from the sucking chamber 106 of the sucking device 100 by that the pump 112 of the sucking force generating portion 104 of the sucking device 100 is driven to rotate to reverse direction. Thus, the recording medium P separates from the upper surface of the sucking portion 101 of the sucking device 100 so as to rise.

Here, in the case that the above sucking hole 108 is formed being tapered to upper surface as shown in FIG. 4, air passing through the sucking hole 108 is accelerated based on the shape thereof, and the recording medium P receives stronger floating force by blowing strongly from the upper end of the sucking hole 108 so as to rise surely.

Since the upper surface of the sucking portion 101 of the sucking device 100 is inclined so as to become low to discharging direction, the recording medium P pretends to fall to lower side by its own weight. Therefore, the recording medium P moves to discharging direction along the inclined upper surface of the sucking device 100 and is discharged out of the printer main body 41 after transported from the recording portion 44. At this time, the recording medium P does not rise by cockling since the recording medium P is kept to suck and stick at the recording medium transportation surface by the sucking device 100 at printing by the recording head 43 as described above.

At discharging, the recording medium P rises by air blowing from the recording medium transportation surface of the sucking device 100, and falls along incline of the recording medium transportation surface by its own weight. Therefore, since the recording medium P is discharged out of the printer main body 41 without using the discharging the prior rowel spur, spur mark does not remain.

Figure 5:
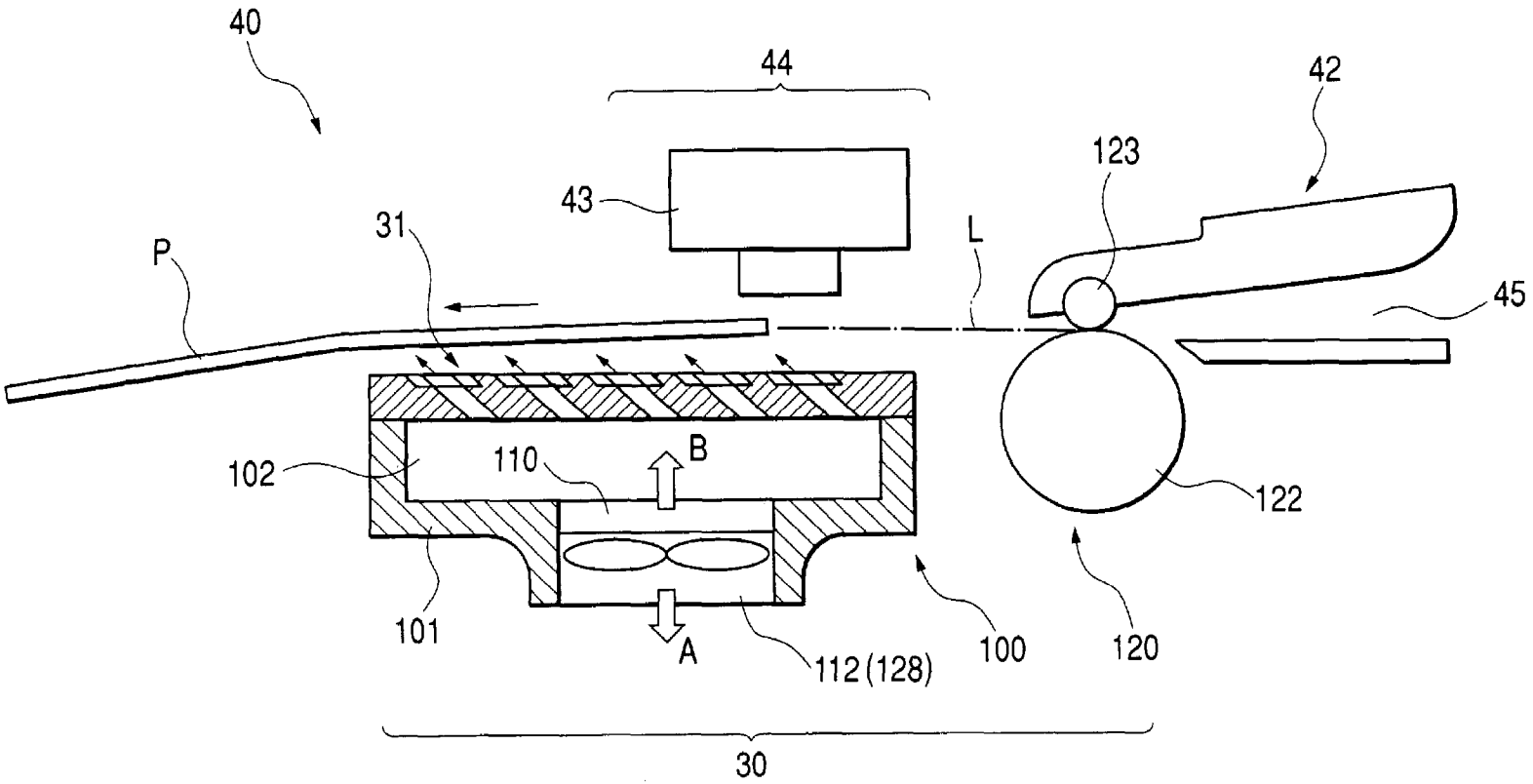
FIG. 5 is a sectional view of outline of the recording medium transportation apparatus according to a second embodiment of the invention.

FIG. 5 shows a second embodiment of the recording medium transportation apparatus according to the invention. In FIG. 5, since a recording medium transportation apparatus 30 has an almost similar construction as the recording medium transportation apparatus 20 shown in FIG. 2, the description will be omitted adding the same symbols for the same components.

The recording medium transportation apparatus 30 has a construction different from the recording medium transportation apparatus 20 shown in FIG. 2 at the following point. That is, in the recording medium transportation apparatus 30, an auxiliary transporting device 31 is constructed by that a sucking hole 108 provided at the upper surface of the sucking portion 101 of the sucking device 100 inclines slantingly to discharging direction to the upper side as shown in FIG. 5 instead of the auxiliary transporting device 31 by the inclined upper surface of the sucking portion 101 of the sucking device 100 in the recording medium transportation apparatus 20 shown in FIG. 2.

Such the construction of the recording medium transportation apparatus 30 operates similarly as the recording medium transportation apparatus 20 shown in FIG. 2. When end edge of the recording medium P is released from between the delivery roller 122 and the driven roller 124 of the recording medium delivering device, the pump 112 of the sucking force generation portion 104 of the sucking device 100 is driven to rotate to reverse direction. By that, air is blown to the upper side from the sucking chamber 106 of the sucking device 100. Thus, the-recording medium P separates from the upper surface of the sucking portion 101 of the sucking device 100 so as to rise.

Since each sucking hole 108 of the sucking portion 101 of the sucking device 100 is inclined, the recording medium P moves to discharging direction along the flat upper surface of the sucking device 100 getting on air current jetting out slantingly from each sucking hole 108 and is discharged out of the printer main body 41 after transported from the recording portion 44. Therefore, the recording medium P does not rise by cockling since the recording medium P is kept to suck and stick at the recording medium transportation surface by the sucking device 100 at printing by the recording head 43 similarly as the recording medium transportation apparatus 20 of FIG. 2.

At discharging, since the recording medium P rises by air blowing from the recording medium transportation surface of the sucking device 100 and is discharged out of the printer main body 41 by the air blowing direction without using the discharging the prior rowel spur, spur mark does not remain.

As above, according to the invention, after finishing printing, the recording medium separates from surface of the recording medium transportation surface, rises slightly, and is moved to discharging direction, that is, downstream side based on incline of the recording medium transportation surface as an auxiliary transporting device or incline of the sucking hole.

Thus, since the recording medium separates from the recording medium transportation surface of the recording medium delivering device and is moved to discharging direction so as to be discharged smoothly after finishing printing, the prior discharging serrated roller is not necessary and spur mark run over caused by the discharging serrated roller does not remain at the recording medium at discharging.

Figure 6:
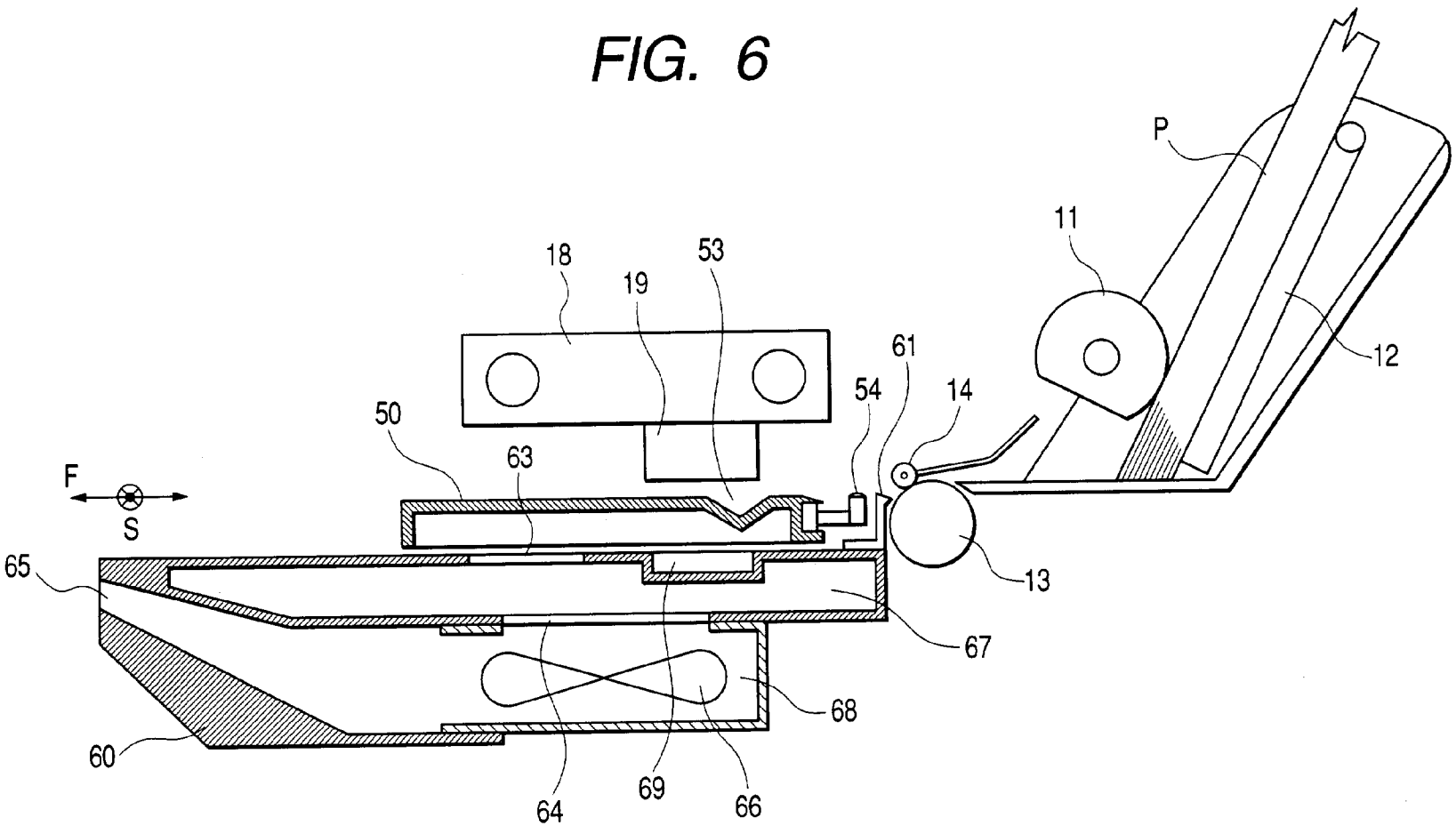
FIG. 6 is a sectional view of outline of the recording medium transportation apparatus according to a third embodiment of the invention.

FIG. 6 shows a recording medium transportation apparatus of a third embodiment. The recording medium transportation apparatus includes a feed roller 11 and a hopper 12 as an automatic sheet feeder, a delivery roller 13, a driven roller 14, a transportation stage 50, and a main body portion 60 as a transportation apparatus, and a carriage 18 and a recording head 19 as a recording device.

The recording medium transportation apparatus supplies the recording medium P by the automatic sheet feeder and prints letter and picture by discharging ink droplet on the recording medium P using recording device while transporting the sheet by a delivering device. Transportation direction of the recording medium P shown with arrow in the figure is placed to F direction and scanning direction of the recording head 19 is placed to S direction hereafter.

Figure 7:
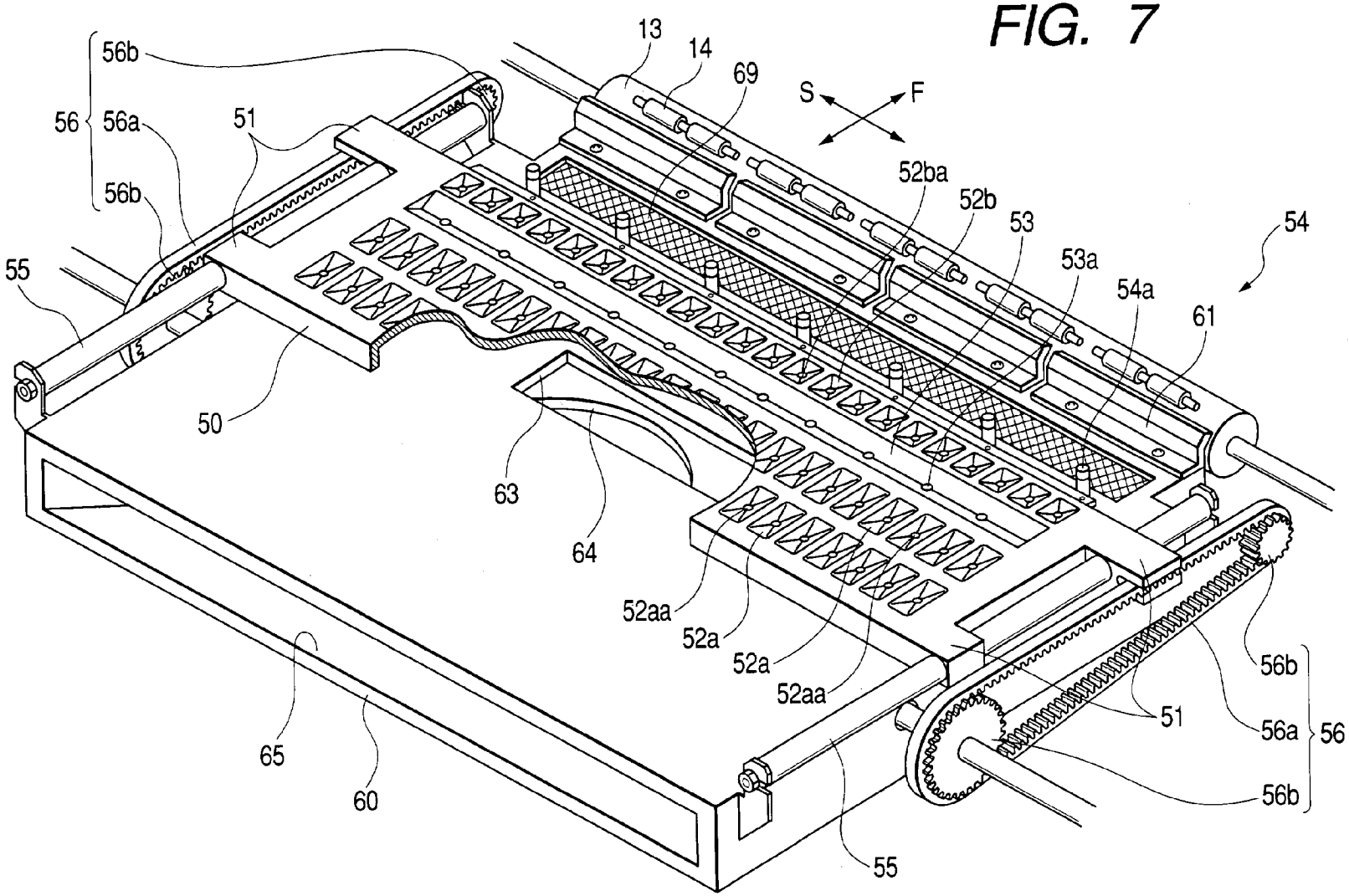
FIG. 7 is a perspective view showing detail example of a transportation stage and a main body portion of the recording medium transportation apparatus of FIG. 6.
Figure 8:
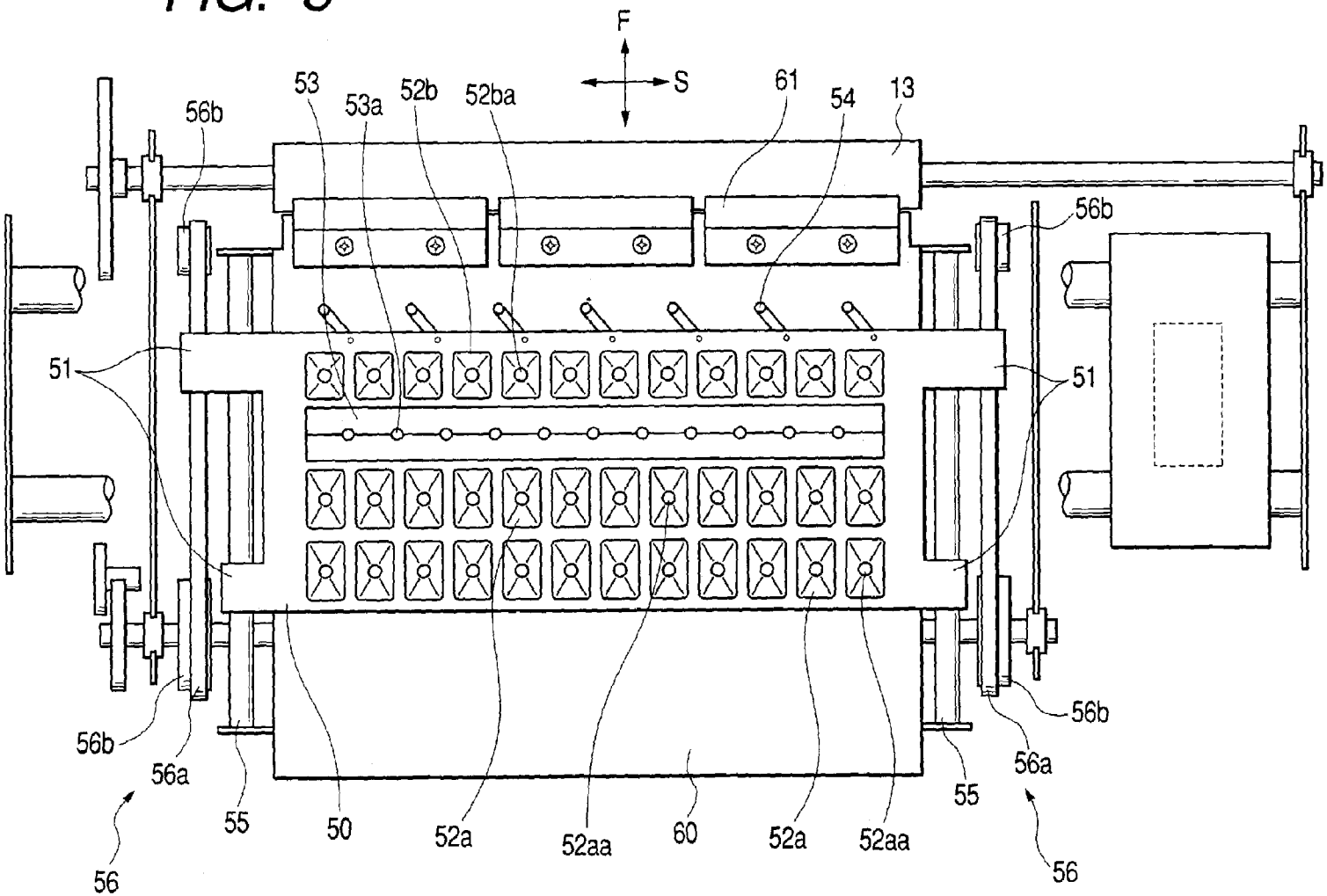
FIG. 8 is a plane view of FIG. 7.

FIG. 7 is a perspective view showing detailed example of the above transportation stage 50 and the main body portion 60, and FIG. 8 is a plane view thereof. The transportation stage 50 and the main body portion 60 will be described below referring FIG. 6 to FIG. 8. The transportation stage 50 formed in rectangle flat plate shape is held by a guide axis 55 attached so that holding portions 51 formed at both end portions of S direction extend to F direction at both end portions of S direction of the main body portion 60, and further is engaged with belts having teeth 56*a* constructing belt drive mechanisms 56 arranged at both sides of S direction of the main body portion 60. The transportation stage 50 moves to F direction along the guide axis 55 at the upper surface of the main body portion 60 by rotating pulleys having teeth 56 and the belts having teeth 56*a* constructing the belt drive mechanisms 56.

Sucking portions 52*a* and 52*b* sucking air to stick the recording medium P, and an ink receiving portion 53 receiving ink thrown away from nozzles of the recording head 19 at printing without margin of the upper end of the recording medium P are formed at the upper surface of the transportation stage 50. Plural sucking portions 52*a* and 52*b* are formed to S direction as a concave portion of quadrangular pyramid shape. The ink receiving portion 53 is formed so as to extend to S direction as a concave portion of one trigonal prism.

Through-holes 52*aa*, 52*ba*, and 53*a* are opened at bottom portion of the sucking portions 52*a* and 52*b*, and the ink receiving portion 53. Thus, ink absorbing material can be dried in short time because air passes through the through-hole 53*a* even at providing the ink absorbing material at the ink receiving portion 53. In this example, two lines of the sucking portion 52*a* are formed facing to the upstream side of F direction from the downstream side of F direction, continuously the ink receiving portion 53 is formed, further the sucking portion 52*b* is formed. The sucking portion 52*b* of highest course side is formed to stick especially the upper and lower ends of the recording medium P.

At the rear portion of the transportation stage 50, plural supporting portions 54 supporting the lower end of the recording medium P are arranged having the predetermined gap. The supporting portion 54 is constructed by a lever 54*a* held rotatably at one end in a groove provided at the rear portion of the transportation stage 50 and a twist coil spring not shown pressing the lever 54*a* to rotating direction. The lever 54*a* of the supporting portion 54 project from the rear portion of the transportation stage 50 by restoring force of the twist coil spring when the rear portion of the transportation stage 50 is separated from a stopper 61 attached at the rear portion of the upper surface of the main body 60.

When the rear portion of the transportation stage 50 makes approach to the stopper 61 attached at the rear portion of the upper surface of the main body 60, the rear portion is stored being push into the groove of the rear portion of the transportation stage 50 springing back against the restoring force of the twist coil spring. Although the lever 54*a* of the supporting portion 54 is attached rotatably in this example, the lever may be attached enabling to act directly using compression coil spring for example.

In the main body portion 60, a hollow portion having two layers to upper and lower directions is formed. At the upper surface of the main body portion 60, a connecting port 63 connecting to the upper layer hollow portion is opened, at the border surface of the two layers hollow portion of the main body portion 60, a connecting port 64 connecting to the upper layer hollow portion and the lower layer hollow portion is opened, and at front surface of the main body portion 60, an exhaust port 65 connecting to the lower hollow portion is opened. The connecting port 63 is formed in rectangle shape at the position released when the transportation stage 50 moves the discharging position of the recording medium P of the front surface side of the main body portion 60. The connecting port 54 is formed in circle shape at almost just under position of the connecting port 63. The exhaust port 65 is formed in rectangle shape having at least width of the recording medium P, and is formed so that passage area from the lower layer hollow portion to the exhaust port 65 becomes small gradually and exhaust faces oblique upper side.

In the lower layer hollow portion of the main body portion 60, an intake fan 66 is arranged. Thus, the upper layer hollow portion of the main body portion 60 functions a decompression chamber 67 acting negative pressure to the sucking portions 52*a* and 52*b*, and the ink receiving portion 53 through the through-holes 52*aa*, 52*ba*, and 53*a* opened at the transportation stage 50. The lower layer hollow portion of the main body portion 60 functions a discharging chamber 68 discharging air in-taken from the through-holes 52*aa*, 52*ba*, and 53*a* opened at the transportation stage 50 through the upper layer hollow portion from the exhaust port 65.

Further, at the upper surface of the main portion 60, an ink receiving portion 69 receiving ink thrown away from nozzles of the recording head 19 at printing without margin of the lower end of the recording medium P is formed. The ink-receiving portion 69 is formed so as to extend to S direction as one quadrangular prism shape at the upstream side of F direction to the connecting port 63 and the place exposing when the transportation stage 50 moves to the front surface side of the main body portion 60. Inside of the ink-receiving portion 69, ink absorbing material may be arranged.

Figure 9:
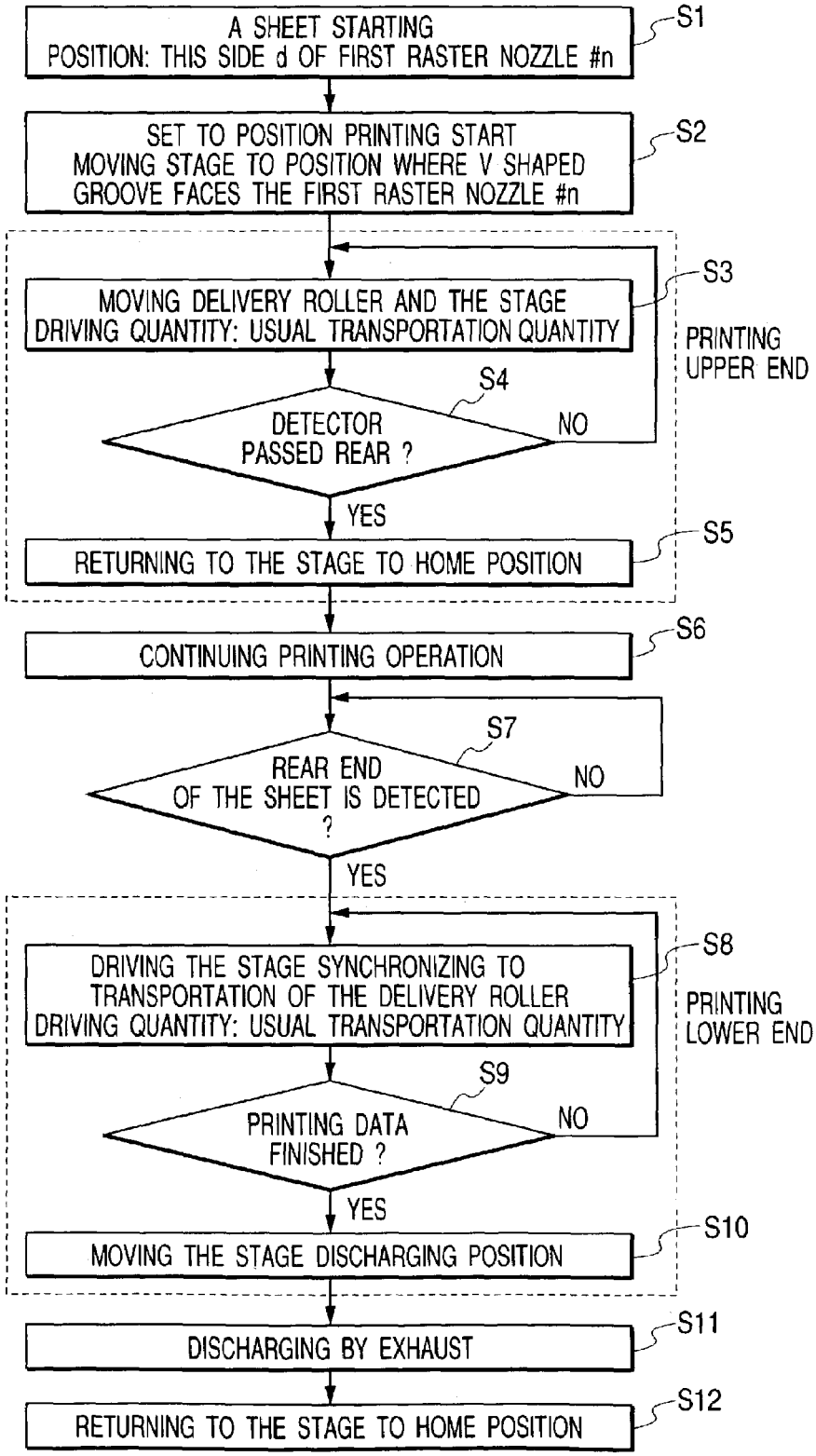
FIG. 9 is a flowchart showing operational example of the recording medium transportation apparatus of FIG. 6.
Figure 10A:
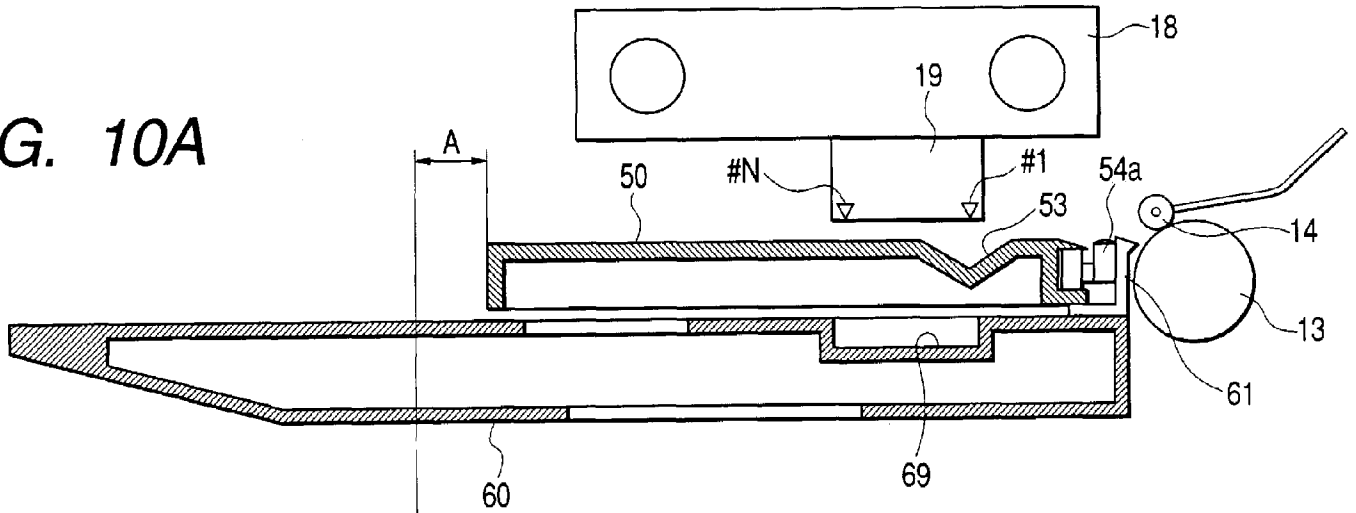
FIGS. 10A and 10B are first and second operational views of the recording medium transportation apparatus of FIG. 6.
Figure 10B:
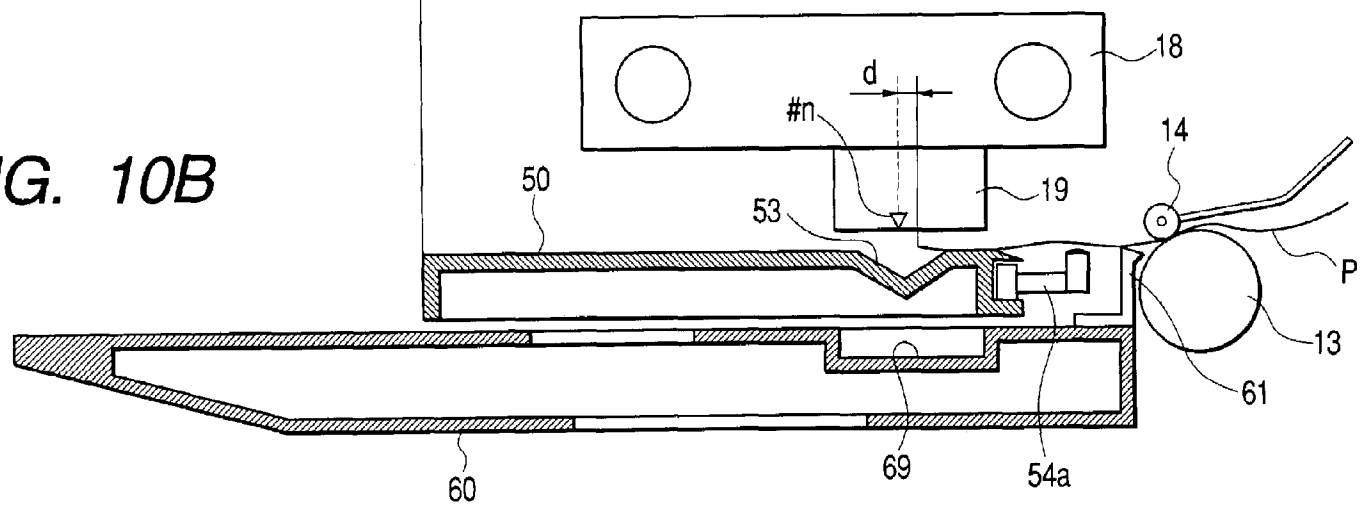

In such the construction, an operational example will be described referring the flowchart of FIG. 9 and operational charts of FIG. 10A to FIG. 13. A control portion of an ink jet printer presses plural sheets of recording media P piled at the hopper 12 to the feed roller 11 by raising the hopper 12 rotating the feed roller 11, and the recording medium P of the highest position is separated to feed from the lower recording media P.

Continuously, the recording medium P is sandwiched between the delivery roller 13 and the driven roller 14 and is transported onto the transportation stage 50 rotating the delivery roller 13. At this time, the transportation stage 50 is positioned at a home position where the lever 54*a* of the supporting portion 54 is stored contacting the stopper 61 of the main body portion 60 as shown in FIG. 1A. The home position means a position where a flag moves the predetermined distance from passing a stage detector detecting the front portion of the side surface of the transportation stage 50, for example, 120/180 inches, when the transportation stage 50 moves to the rear portion side of the main body portion 60.

The recording medium P starts to feed. Concretely, the recording medium P is transported so that the upper end of the recording medium P comes to the position of this side of a first raster position at printing with normal transportation quantity, that is, the position separated distance d from a first raster nozzle #n being the highest end used at printing of the first path shown in FIG. 10B to the rear portion side of the transportation stage 50 (Step S1).

Further, the transportation stage 50 is set to the print starting position adding to the above. Concretely, the recording medium P is moved so that the top portion of the ink receiving portion 53 being V-shaped groove formed at the transportation stage 50 comes to the position facing the first raster nozzle #n (Step S2). At this time, the upper end of the recording medium P is flat being stuck by the sucking portion 52*b* so as to improve printing quality keeping stable paper gap, and it is possible to prevent contamination by rubbing with the recording head 19 by reducing rising of the recording medium P.

Next, printing without margin of the upper end starts. That is, the delivery roller 13 is rotated as usual transportation quantity, and the recording medium P is moved to the front portion side of the main body portion 60 synchronizing with rotation of the delivery roller 13 (Step S3). At this time, since ink received at the ink receiving portion 53 is discharged outside from the rough-hole 53*a* without remaining inside, contamination of the recording medium P caused by ink can be reduced comparing with the case only being absorbed by ink absorbing material and manpower of maintenance such as change of ink absorbing material and the like can be reduced.

Figure 14:
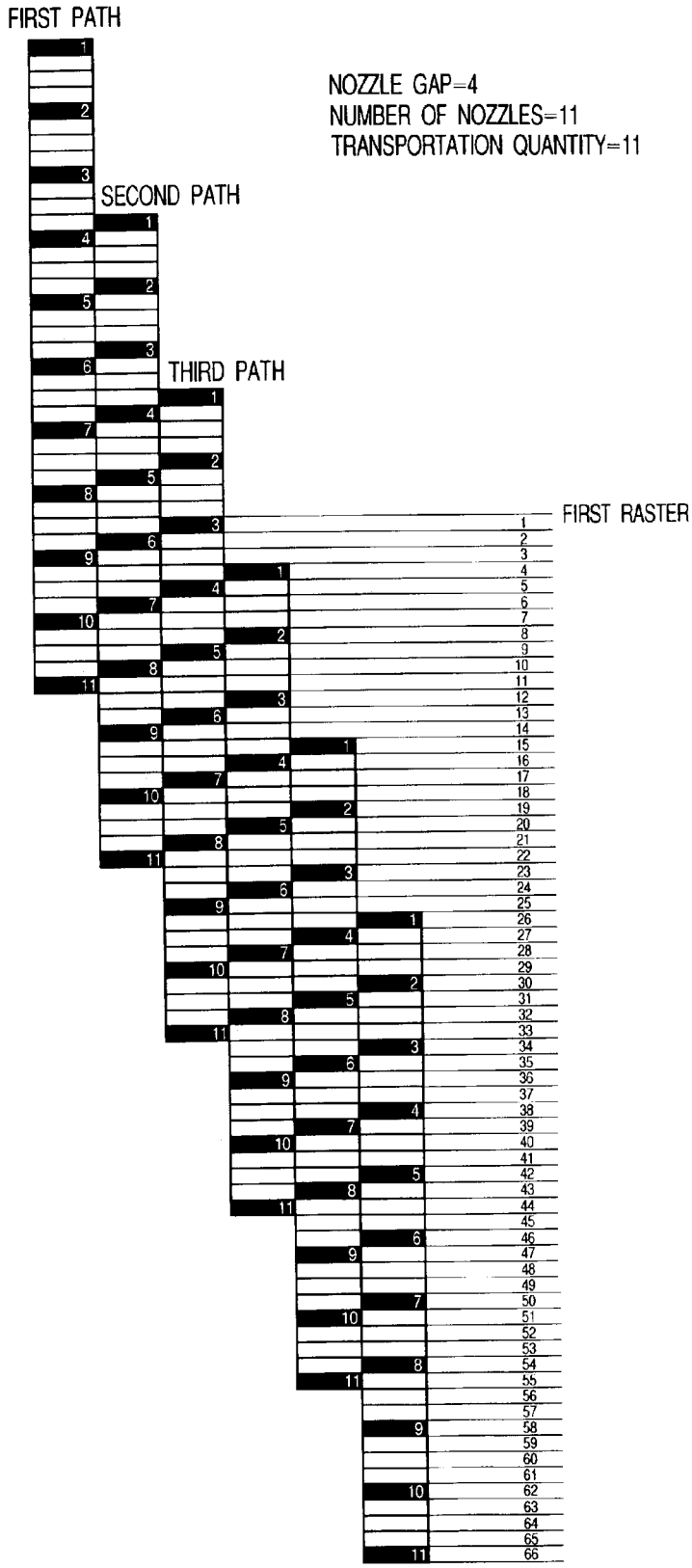
FIG. 14 is a view showing using nozzles of a recording head at performing printing without margin of an upper end by an ink jet printer assembling the recording medium transportation apparatus of FIG. 6.
Figure 15:
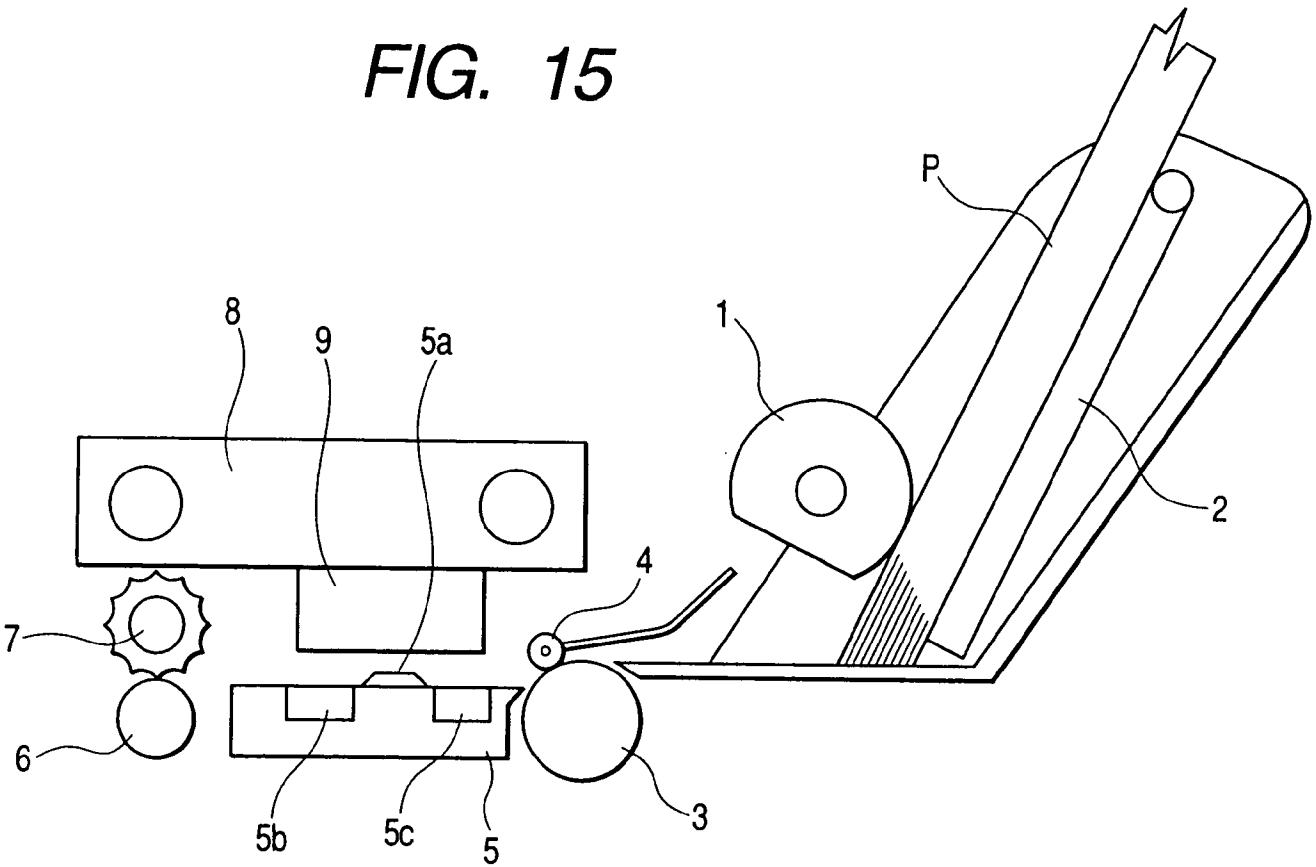
PRIOR ART FIG. 15
FIG. 15 is a side view showing inside construction of the prior ink jet printer.
Figure 16A:
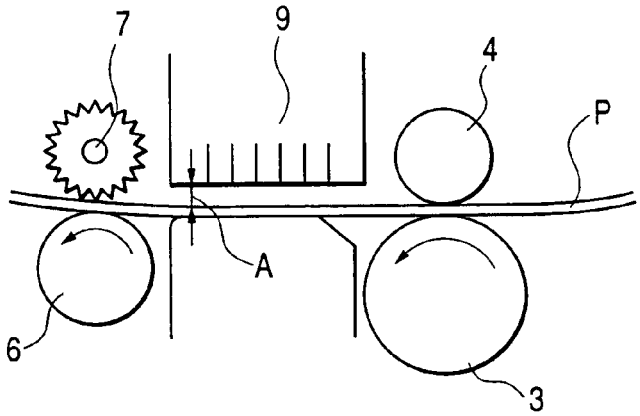
PRIOR ART FIG. 16A
FIGS. 16A to 16C are views showing a recording portion and a transportation apparatus of a fixed material abstracted at main portion thereof.
Figure 16B:
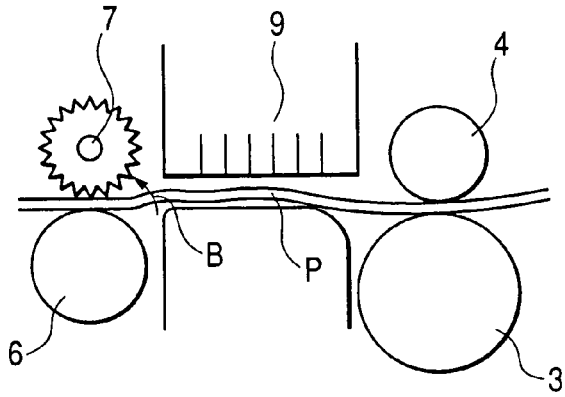
PRIOR ART FIG. 16B
Figure 16C:
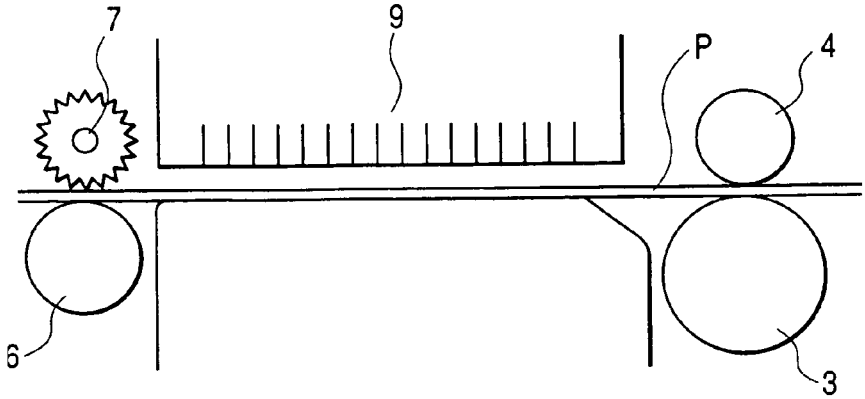
PRIOR ART FIG. 16C
Figure 17:
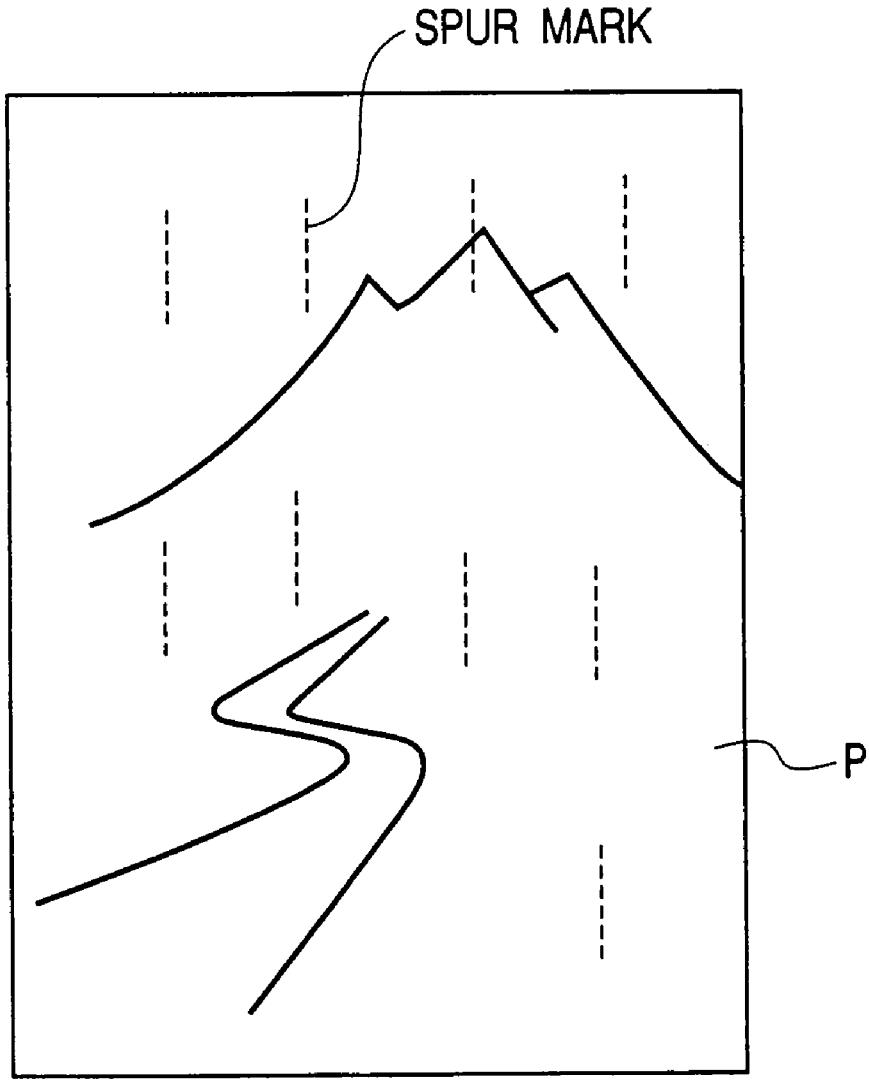
PRIOR ART FIG. 17
FIG. 17 is a view showing spur mark of picture recorded by the ink jet printer of FIGS. 16A to 16C.

In the printing without margin of the upper end for example as shown in FIG. 14, setting to 4 pitches for gap of nozzle of the recording head 19, to 11 for number of nozzles, and to 11 pitches for transportation quantity, printing without margin of the upper end is performed by ink droplets discharged from nozzles of #8 to #11, and ink droplets discharged from nozzles of #1 to #8 are thrown away to the ink receiving portion 53 at the first path. At the second path, printing without margin of the upper end is performed by ink droplets discharged from nozzles of #5 to #11, and ink droplets discharged from nozzles of #1 to #4 are thrown away to the ink receiving portion 53. Further, at the third path, printing without margin of the upper end is performed by ink droplets discharged from nozzles of #3 to #11, and ink droplets discharged from nozzles of #1 to #2 are thrown away to the ink receiving portion 53. Printing without margin of the upper end is performed by ink droplets discharged from whole nozzles at passes after the fourth path.

Figure 11A:
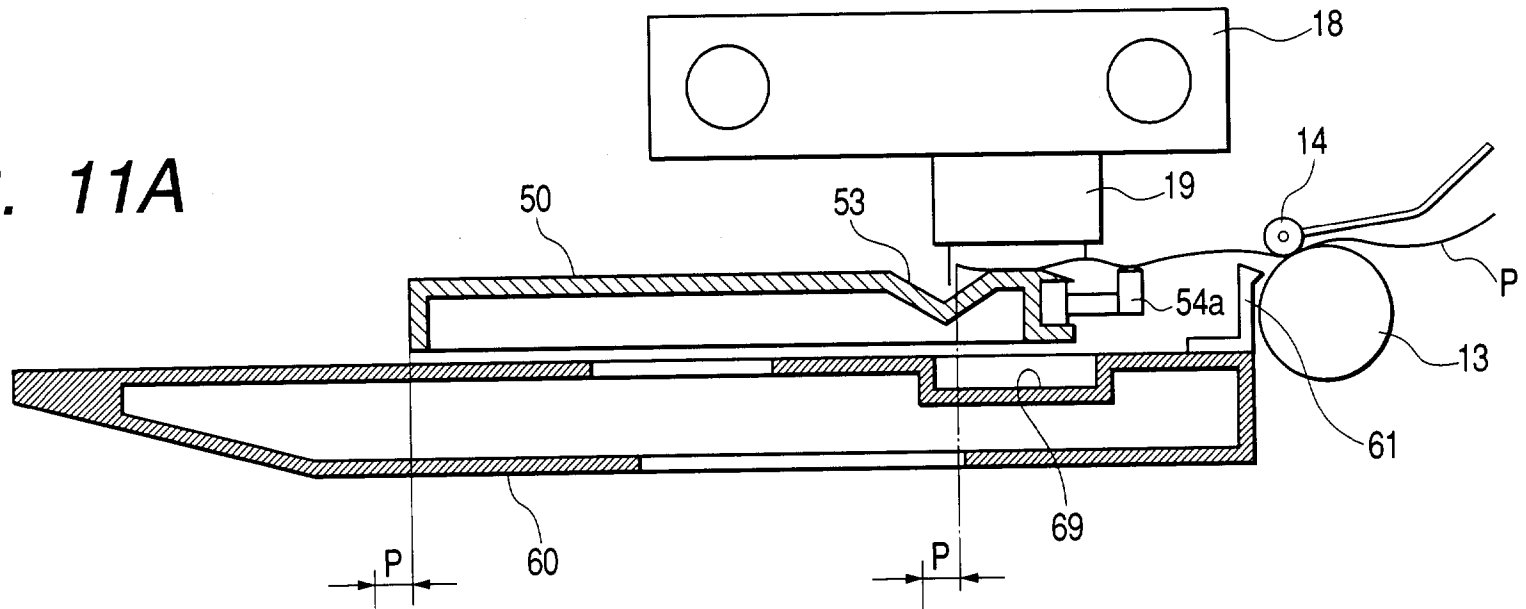
FIGS. 11A and 11B are third and fourth operational views of the recording medium transportation apparatus of FIG. 6.
Figure 11B:
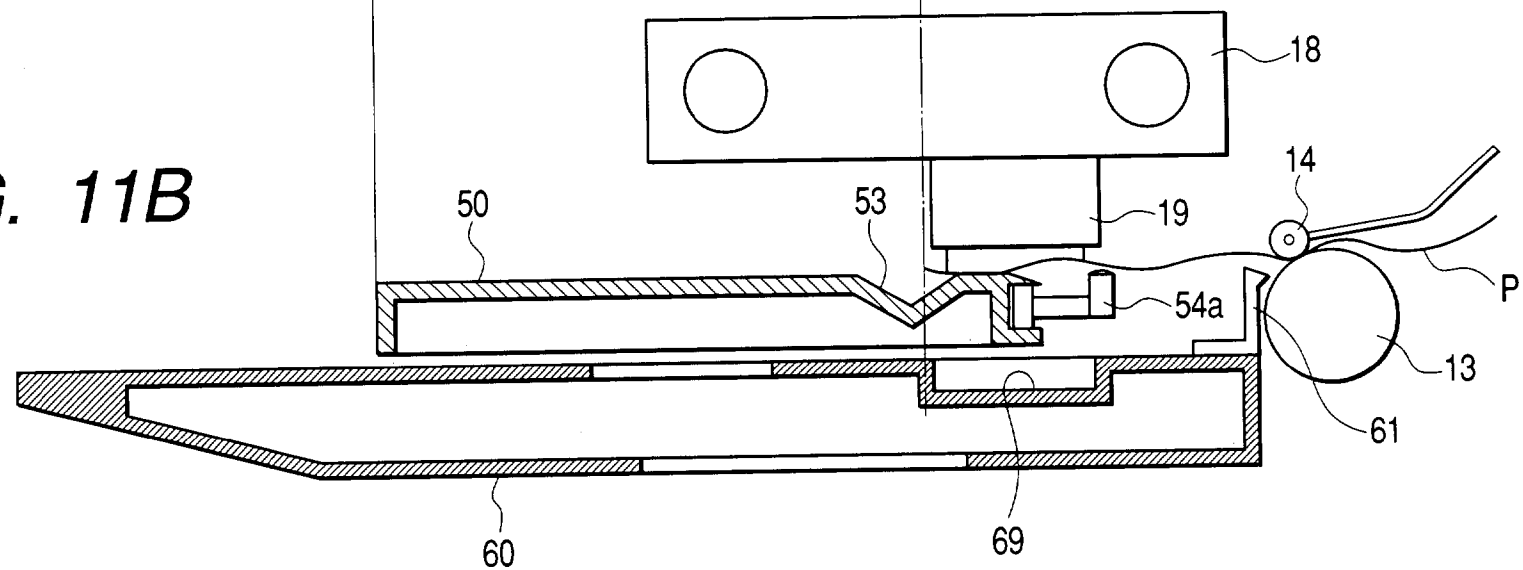
Figure 12A:
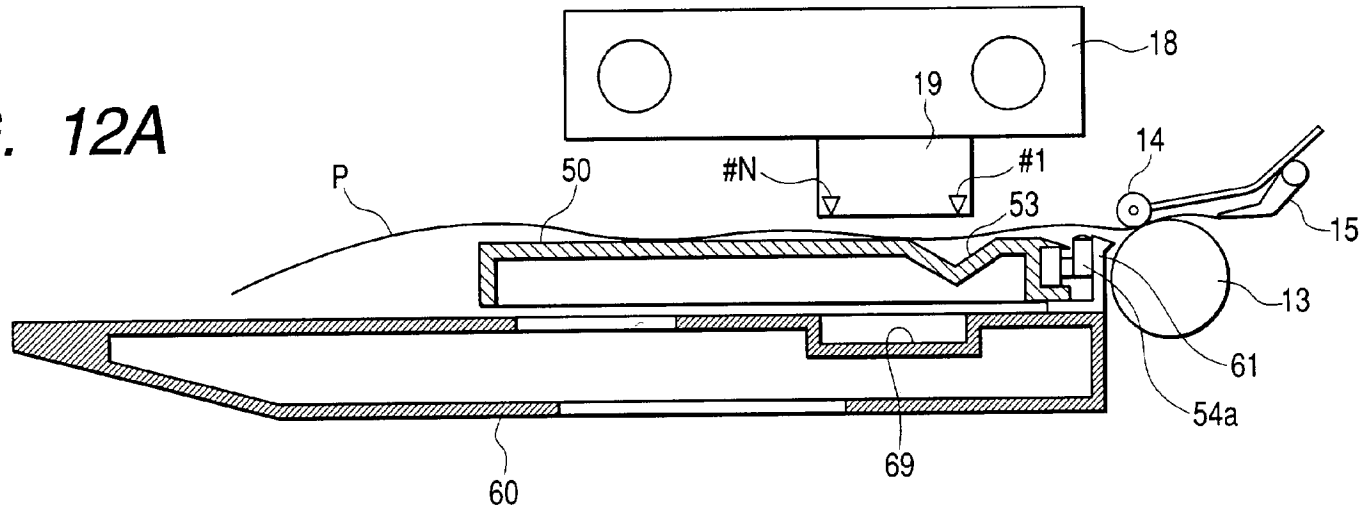
FIGS. 12A and 12B are fifth and sixth operational views of the recording medium transportation apparatus of FIG. 6.

When the flag of the transportation stage 50 passes through the stage detector detecting the rear portion of side surface of the transportation stage 50 as shown in FIGS. 11A and 11B (Step S4), printing operation is continued rotating the delivery roller 13 as usual transportation quantity, and only the transportation stage 50 is returned to the home position moving to the rear portion side of the main body portion 60 as shown in FIG. 12A (Step S5). Thus, since the recording medium P, from the upper end to the lower end thereof, can be supported on the transportation stage 50, stable paper gap is kept over whole surface of the recording medium P so as to improve printing quality.

Next, when a paper detector 15 detects the lower end of the recording medium P while continuing printing operation (Steps S6 and S7), printing without margin of the lower end is started. That is, when the paper detector 15 detects the lower end of the recording medium P, the transportation stage 50 starts to move to the front portion side of the main body portion 60 with the same moving quantity as the usual transportation quantity by the delivery roller 13 (Step S8). Thus, since transfer from transportation of the recording medium P by the delivery roller 13 to transportation of the recording medium P by the transportation stage 50 can be performed smoothly, printing quality of whole surface of the recording medium P can be improved. At this time, synchronizing of transporting speed of the recording medium P by the transportation stage 50 and transportation speed of the recording medium P by the delivery roller 13 is not necessary because it is sucked by slipping of the recording medium P.

Figure 12B:
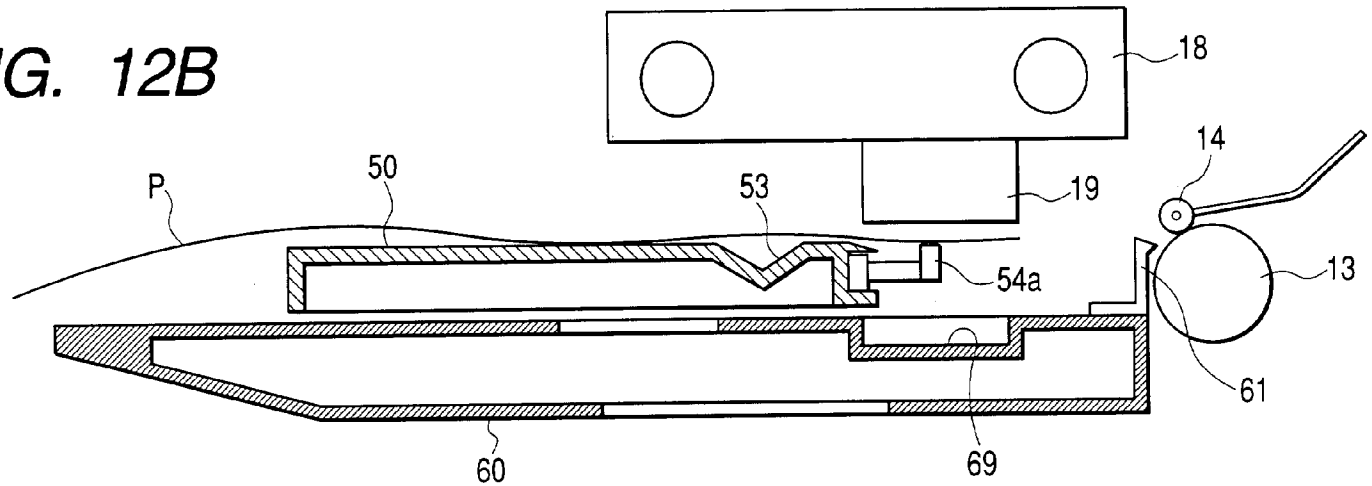

When the lower end of the recording medium P comes off from the delivery roller 13, the recording medium P is kept to stick on the transportation stage 50 for transportation as shown in FIG. 12B. At this time, the lower end of the recording medium P on the transportation stage 50 is flat being sucked by the sucking portion 52*b*, and further the lower end of the recording medium P projecting from the rear end of the transportation stage 50 is supported by the supporting portion 54. Therefore, stable paper gap is kept so as to improve printing quality and rise of the recording medium P is reduced so as to prevent contamination caused by rubbing with the recording head 19 because the recording medium P does not fall even if the recording medium P is drawn by influence of intake-air sticking the recording medium P. When the transportation stage 50 moves, ink droplets thrown away coming off from the lower end of the recording medium P are received by the ink receiving portion 69 because the ink receiving portion 69 of the main body portion 60 exposes.

Figure 13:
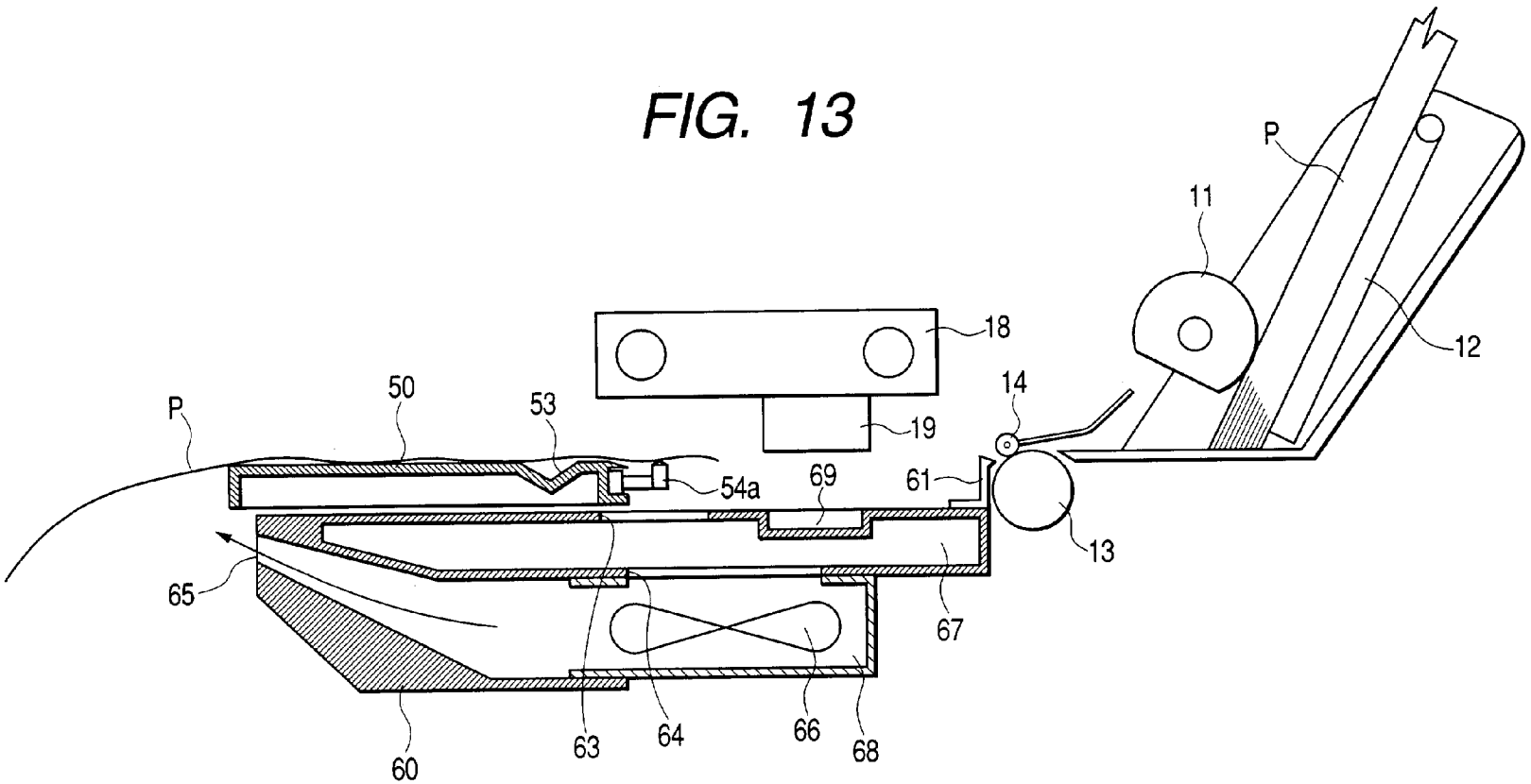
FIG. 13 is a seventh operational view of the recording medium transportation apparatus of FIG. 6.

When printing data is finished (Step S9), the recording medium P is discharged. That is, when printing data is finished, the transportation stage 50 is moved to discharging position driving continuously as shown in FIG. 13 (Step S10). The discharging position means a position where a flag moves the predetermined distance from passing a stage detector detecting the rear portion of the side surface of the transportation stage 50, for example, 28/180 inches, when the transportation stage 50 moves to the front portion side of the main body portion 60.

When the transportation stage 50 moves to the discharging position, a part of the connecting port 53 is released so that sucking force of the sucking portions 52*a* and 52*b* is reduced, and at the same time discharging quantity of the exhaust port 65 is increased. Because of that, the recording medium P which has been stuck on the transportation stage 50 till then is pushed out on a discharging stacker not shown by air blowing from the exhaust port 65 (Step S11). Thus, since the discharging roller of the recording medium P and the like are unnecessary, the recording medium P can be discharged at good state without spur mark, rubbing of ink, and so on. After that, the transportation stage 50 is returned to the home position moving to the rear portion side of the main body portion 60 (Step S12) so as to finish printing process.

As described above, since a belt drive mechanism 62 is connected and the sucking portions 52*a* and 52*b* are formed in the transportation stage 50, the recording medium P can be transported by moving the transportation stage 50 sticking the upper or lower end of the recording medium P on the transportation stage 50. Since the ink receiving portion 69 for printing without margin of the lower end is formed at the main body portion 60, only one ink receiving portion 53 for printing without margin of the upper end may be provided at the transportation stage 50.

Therefore, since it is not necessary to provide the rib having been necessary until now to keep paper gap and to reduce transportation resistance on the transportation stage 50, the problem described in the prior art can be solved. Because of that, since printing without margin of the upper and lower ends can be performed with usual printing speed using whole nozzles similarly as usual printing, printing operation time can be shortened, and printing quality of whole surface of the sheet can be improved removing border of a part of printing without margin of the upper and lower ends and usual printing part.

Although plane shape of the ink receiving portion 53 formed at the transportation stage 50 is rectangle in the above embodiment, the rectangle shape of the ink receiving portion 53 may be formed in trapezoid shape having rake angle to sheet width direction in order that the end portion of the recording medium P is not caught by the ink receiving portion 53 when the transportation stage 50 returns to the home position. Further, a honeycomb shaped trap for trapping ink mist sucked inside of a decompression chamber 67 of the main body portion 60 may be provided.

Although it is controlled that only the transportation stage 50 is returned to the home position moving to the rear portion side of the main body portion 60 when the flag of the transportation stage 50 passes through the stage detector detecting the rear portion of side surface of the transportation stage 50, it is controlled that only the transportation stage 50 is returned to the home position moving to the rear portion side of the main body portion 60 when the upper end of the recording medium P passes through the nozzle #N.

Although the transportation stage 50 is moved to discharging position and the recording medium P is discharged after reducing sucking force of the sucking portions 52*a* and 52*b* releasing a part of the connecting port 62, a flap enabling to open and close is provided at the upper surface of the main body portion 60 for example, the flap is opened when the transportation stage 50 moves to the discharging position, letting air blow from the sucking portions 52*a* and 52*b* making inside of the transportation stage 50 positive pressure, and the recording medium P may be discharged after floating the recording medium P.

Further, in order to discharge the recording medium P straightly not rotatingly, the recording medium P may be discharged preventing rotation by pushing right side surface of the recording medium P to an edge guide of right side viewing from the front portion of the transportation stage 50. Because of that, a partition plate extending to F direction is provided inside of the transportation stage 50 to divide to rooms, the recording medium P is sucked by generating negative pressure for the room of right side viewing from the front portion of the transportation stage 50, the recording medium P is floated by generating positive pressure for the room of left side, and right side surface of the recording medium P is pushed to the edge guide to prevent rotating. By bonding rubber and the like at transportation surface of right side viewing from the front portion of the transportation stage 50, it is set that friction resistance of the transportation surface of right side is higher than friction resistance of the transportation surface of left side, and rotation is prevented by pushing right side surface of the recording medium P. By forming the exhaust port 65 so as to become wider at right side viewing the front portion of the main body portion 60 than left side not forming the simple rectangular shape, air flow velocity of right side becomes slower than air flow velocity of left side, and right side surface of the recording medium P is pushed to the edge guide so as to prevent rotation.

Although the printer is described as an example of the ink jet recording apparatus in each of the above embodiments, a facsimile apparatus, a copying machine, and the like may be applicable if it is a recording apparatus having the transportation apparatus of the recording medium without limiting to this. Although various kinds of embodiments are described, the invention is not limited to the above embodiments, it is off course applicable for another embodiments in the scope of the invention described in the claims.

As described above, according to the invention, since the discharging roller of the recording medium and the like are necessary, the recording medium can be discharged at the good state not having spur mark, rubbing of ink, and so on. Since the connecting port is released so as to reduce passage load when the stage moves to the discharging position of the recording medium, it is possible that quantity of discharging air is increased by reducing sucking force sticking the recording medium and the recording medium is discharged surely.

Further, since transfer from transportation of the recording medium by the delivery roller to transportation of the recording medium by the stage can be performed smoothly, it is possible to improve recording picture of whole surface of the recording medium including the lower end. Since the upper end of the recording medium can be transported by moving of the stage sticking on the stage and one ink receiving portion for printing without margin of the upper end may be provided, it is not necessary to provide the rib necessary to keep the paper gap and to reduce transportation resistance on the stage, the problem described in the prior art can be solved. Therefore, since printing without margin of the upper and lower ends can be performed with usual printing speed using whole nozzles, printing operation time can be shortened, and printing quality of whole surface of the recording medium can be improved.

What is claimed is:

1. A medium transportation apparatus comprising:

a sucking device for sucking a medium and a delivering device for transporting a medium from an upstream side to a downstream side of the sucking device, the sucking device having a medium transportation surface on which a plurality of sucking holes are formed, a decompression chamber connected to the sucking holes, and a sucking force generating portion for sucking air in the decompression chamber;

wherein the medium supplied by the delivering device on the medium transportation surface is transported from the upstream side to the downstream side while being stuck on the medium transportation surface by suction of the sucking device through the sucking holes when a liquid fixing on the medium is conducted, and wherein the delivering device includes a blowing device for blowing air into the decompression chamber of the sucking device after finishing the liquid fixing and an auxiliary transporting device moving subsidiarily the medium to a discharging direction of the medium.

2. A medium transportation apparatus according to claim 1, wherein the auxiliary transporting device is so constructed that the sucking holes of the sucking device are opened slantingly to a discharging direction of the medium.

3. A medium transportation apparatus according to claim 1, wherein the auxiliary transporting device is so constructed that the medium transportation surface of the sucking device is inclined so as to become lower toward the discharging direction.

4. A medium transportation apparatus according to claim 2, wherein the sucking device blows air into the decompression chamber by reversing, so that the sucking device serves as the blowing device.

5. A liquid fixing apparatus including the medium transportation apparatus according to claim 1.

6. A medium transportation apparatus according to claim 1, wherein the sucking force generating portion blows air into the decompression chamber by a reverse motion, so that the sucking force generating portion serves as the blowing device.

7. A medium transportation apparatus according to claim 1, wherein the sucking holes are formed as sucking chambers at the medium transportation surface, such that the sucking chambers connect to the decompression chamber via the sucking holes.

8. A medium transportation apparatus according to claim 1, wherein the sucking holes are tapered such that a diameter of the sucking holes is gradually reduced from a lower portion of the sucking holes to an upper portion of the sucking holes.

9. A medium transportation apparatus according to claim 1, wherein the sucking force generation portion switches a blowing direction for discharging the air from the sucking holes after finishing the liquid fixing, so that the sucking force generation portion serves as the blowing device.

10. A medium transportation apparatus according to claim 1, wherein the medium transportation surface, on which the sucking holes are formed, is provided in a fixing area where the liquid fixing is conducted and in a downstream side of the fixing area.

11. A medium transportation apparatus according to claim 1, wherein the air is discharged perpendicularly to a fixing area on which the liquid fixing is conducted, whereby the medium is caused to float.

12. A medium transportation apparatus according to claim 1, wherein the blowing direction of the blowing device is perpendicular to a fixing area on which the liquid fixing is conducted.

13. A medium transportation apparatus comprising:

a sucking device for sucking a medium and a delivering device for transporting a medium from an upstream side to a downstream side of the sucking device, the sucking device having a medium transportation surface on which a plurality of sucking holes are formed, a decompression chamber connecting to the sucking holes, and a sucking force generating portion for sucking air in the decompression chamber, wherein the medium transportation surface of the sucking device is inclined so as to become lower toward a discharging direction, and the sucking force generating portion is operative to blow air into the decompression chamber by a reverse motion.

* * * * *